US010952534B2

(12) United States Patent
Peck et al.

(10) Patent No.: US 10,952,534 B2
(45) Date of Patent: Mar. 23, 2021

(54) LOW VOLTAGE MODULAR SHELF SYSTEM

(71) Applicant: Product Miniature, Inc., Pewaukee, WI (US)

(72) Inventors: Christopher Peck, Williams Bay, WI (US); Craig Fluegge, Menomonee Falls, WI (US); Michael Ford, Brookfield, WI (US)

(73) Assignee: Product Miniature, Inc., Pewaukee, WI (US)

( * ) Notice: Subject to any disclaimer, the term of this patent is extended or adjusted under 35 U.S.C. 154(b) by 0 days.

(21) Appl. No.: 16/447,402

(22) Filed: Jun. 20, 2019

(65) Prior Publication Data

US 2019/0387902 A1 Dec. 26, 2019

Related U.S. Application Data

(60) Provisional application No. 62/688,816, filed on Jun. 22, 2018, provisional application No. 62/703,532, filed on Jul. 26, 2018.

(51) Int. Cl.

| | |
|---|---|
| ***A47B 57/16*** | (2006.01) |
| ***A47B 96/02*** | (2006.01) |
| ***A47B 57/40*** | (2006.01) |
| ***A47F 5/10*** | (2006.01) |
| ***A47F 11/10*** | (2006.01) |
| ***F21V 21/35*** | (2006.01) |
| *A47F 5/00* | (2006.01) |
| *F21Y 115/10* | (2016.01) |
| *A47F 5/08* | (2006.01) |

(52) U.S. Cl.

CPC ..... *A47B 57/16* (2013.01); *A47B 57/404* (2013.01); *A47B 57/406* (2013.01); *A47B 96/024* (2013.01); *A47B 96/025* (2013.01); *A47F 5/10* (2013.01); *A47F 11/10* (2013.01); *F21V 21/35* (2013.01); *A47F 5/005* (2013.01); *A47F 5/0018* (2013.01); *A47F 5/0823* (2013.01); *A47F 5/105* (2013.01); *F21Y 2115/10* (2016.08)

(58) Field of Classification Search

CPC ..... A47B 2220/0077; A47F 5/0018; F21V 21/35

USPC ..... 108/23; 362/133, 127

See application file for complete search history.

(56) References Cited

U.S. PATENT DOCUMENTS

| | | | |
|---|---|---|---|
| 2,921,693 | A | 1/1960 | McLean |
| 3,101,681 | A | 8/1963 | Streater |
| 4,689,726 | A | 8/1987 | Kretzschmar |
| 5,034,861 | A | 7/1991 | Sklenak et al. |

(Continued)

FOREIGN PATENT DOCUMENTS

| | | |
|---|---|---|
| CA | 2758626 | 5/2013 |
| EP | 2768085 | 2/2014 |
| GB | 2063586 | 6/1981 |

OTHER PUBLICATIONS

PCT/US2019/038393, International Search Report and Written Opinion, dated Oct. 4, 2019, 11 pages.

*Primary Examiner* — Jose V Chen

(74) *Attorney, Agent, or Firm* — Boyle Fredrickson, S.C.

(57) ABSTRACT

A modular shelf system having spaced apart upright subassemblies that each include multiple recesses conductive support standards, which are configured for receiving a low voltage current and illuminating the LED arrays of shelf fixtures that span adjacent upright subassemblies.

20 Claims, 16 Drawing Sheets

(56) References Cited

U.S. PATENT DOCUMENTS 5,065,290 A 11/1991 Makar et al.
5,297,486 A 3/1994 Herrmann et al.
5,415,301 A 5/1995 Bruton et al.
5,433,327 A 7/1995 Benvenuti et al.
5,472,103 A 12/1995 Merl
5,690,415 A 11/1997 Krehl
5,944,203 A 8/1999 Vlah et al.
6,112,913 A 9/2000 Rindoks et al.
6,142,320 A 11/2000 DeLorean et al.
6,179,434 B1 1/2001 Saraiji et al.
6,270,232 B1 8/2001 Shemitz et al.
6,431,721 B2 8/2002 Shemitz et al.
6,558,017 B1 5/2003 Saraiji et al.
6,644,609 B1 11/2003 Scott
6,827,465 B2 12/2004 Shemitz et al.
7,121,675 B2 10/2006 Ter-Hovhannisian
7,163,305 B2 1/2007 Bienick
7,600,887 B2 10/2009 Sherman
7,614,350 B2 11/2009 Tuttle et al.
7,824,055 B2 11/2010 Sherman
7,857,214 B2 * 12/2010 Saliaris ..... G06F 1/181 235/383
8,215,795 B2 7/2012 Pichel
8,360,254 B2 1/2013 Topping et al.
8,646,935 B2 2/2014 Karan
8,979,296 B2 * 3/2015 Wiemer ..... A47F 5/103 362/125
9,222,645 B2 * 12/2015 Breslow ..... A47F 3/001
9,245,464 B2 * 1/2016 Theisen ..... G09F 19/00
9,537,274 B1 * 1/2017 Dankelmann ..... A47F 3/001
10,101,521 B1 * 10/2018 Burgio, Jr. ..... G02B 6/0095
10,130,196 B2 * 11/2018 Burns ..... F21V 23/06
10,504,389 B2 * 12/2019 Tewksbury ..... A47F 11/06
10,631,635 B2 * 4/2020 Breslow ..... F21V 23/008
2005/0263466 A1 12/2005 Libman
2006/0209537 A1 * 9/2006 Stelmasik ..... A47F 11/10 362/217.16
2007/0210023 A1 9/2007 Mower
2008/0043456 A1 2/2008 Bernardini et al.
2008/0084684 A1 * 4/2008 Harney ..... G09F 13/04 362/33
2008/0092782 A1 4/2008 Daniel
2008/0198600 A1 8/2008 Crandell et al.
2008/0217269 A1 9/2008 Topping et al.
2009/0226656 A1 9/2009 Crandell et al.
2011/0027387 A1 2/2011 Olsen
2011/0044030 A1 2/2011 Pichel
2011/0063844 A1 3/2011 Swafford et al.
2011/0204009 A1 8/2011 Karan
2011/0273867 A1 11/2011 Horst et al.
2011/0310598 A1 12/2011 Swafford
2013/0188356 A1 7/2013 Breslow et al.
2013/0242561 A1 * 9/2013 Kramer ..... H01R 25/142 362/253
2014/0055987 A1 * 2/2014 Lindblom ..... A47F 11/10 362/125
2014/0218896 A1 8/2014 Karan
2014/0224875 A1 * 8/2014 Slesinger ..... G06Q 10/087 235/385
2014/0235093 A1 * 8/2014 Harlan ..... A47B 97/00 439/370
2014/0313722 A1 * 10/2014 Eloff ..... A47B 95/043 362/249.04
2014/0376213 A1 * 12/2014 Miedema ..... F21V 33/0024 362/127
2015/0092397 A1 * 4/2015 Liu ..... F21V 23/045 362/127
2015/0216329 A1 8/2015 Topping et al.
2015/0223601 A1 * 8/2015 Zang ..... A47B 47/0083 108/23
2015/0289681 A1 * 10/2015 Sun ..... A47F 5/103 108/23
2016/0088955 A1 3/2016 Lilja et al.
2016/0316939 A1 * 11/2016 Kraiss ..... A47F 5/103
2017/0329064 A1 * 11/2017 Dor ..... G02B 6/001
2018/0180261 A1 * 6/2018 Xue ..... F21V 17/16
2018/0180276 A1 * 6/2018 Zeng ..... F21S 4/20
2018/0313602 A1 11/2018 Akca et al.
2019/0191894 A1 * 6/2019 Xu ..... G09F 9/33
2019/0298083 A1 * 10/2019 Lee ..... H01R 25/147
2019/0309938 A1 * 10/2019 Towfigh ..... F21V 23/00
2019/0376655 A1 * 12/2019 Sburlan ..... A47G 23/0266

* cited by examiner

LOW VOLTAGE MODULAR SHELF SYSTEM

CROSS-REFERENCE TO RELATED APPLICATIONS

This application claims priority to U.S. provisional application Ser. No. 62/688,816, filed Jun. 22, 2018, and U.S. provisional application Ser. No. 62/703,532, filed Jul. 26, 2018, the entire contents of which are both incorporated by reference.

BACKGROUND OF THE INVENTION

1. Technical Field

The present disclosure generally relates to a modular shelf system and more particularly to a variable configuration modular retail shelf system that may include integrated low voltage illumination.

2. Background Art

Typically, retail stores often display products for sale on non-illuminated shelf systems. Often these shelf systems are configurable to accommodate various size products and product displays. For example, traditional peg board and shelf gondolas allow individual shelves to be placed at various locations, e.g., heights, relative to the back wall. Alternatively, the traditional shelf systems may accommodate customized shelves configured to accommodate the display of particular packaging, for example cosmetic products, soup cans, clam shell packaging, etc.

Advancements in the area of retail shelving have recently included the integration of low-cost illumination directly into shelves by way of LED lighting. The present invention seeks to improve upon the prior art by providing a modular retail shelf system that is both highly configurable and may selectively provide product LED shelf illumination through a conductive standard that is located within a modular upright subassembly.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

SUMMARY OF THE INVENTION

It is therefore an object of the present invention to provide a shelf system having a modular retail shelf system that is adjustable and may be configured to conduct low voltage current to illuminated shelf fixtures through conductive support standards.

It is another object of the present invention to provide a shelf system that can be readily assembled as variable height and widths during installation with minimal effort or labor.

It is another object of the present invention to provide electrical conduction through the modular shelf system to illuminate lighting fixtures integrated into the modular retail self-system.

It is another object of the present invention to provide a shelf system having configurable LED illuminated shelves having an electrical current conducted through a structural support or upright within the modular retail shelf system.

In one aspect of the invention, illuminated low voltage modular shelf system is provided including at least two spaced apart upright subassemblies, each subassembly including a first and second electrically conductive support standard recessed within an upright. The system also provides at least one shelf fixture configured to be removably mounted to at least one of the support standards in each of a first and second upright subassemblies selected from the at least two spaced apart upright subassemblies and an LED array disposed within the at least one shelf fixture receiving an electrical current from a low voltage power supply that is conducted to the at least one shelf fixture through the electrically conductive support standards.

In another aspect of the invention, each upright comprises a first support standard channel having an exposed front surface and a second support standard channel having an exposed front surface.

In yet another aspect of the invention, a first end of the LED array disposed within the at least one shelf fixture is in removable electrical contact with the first electrically conductive support standard of the first upright subassembly and a second end of the LED array is disposed within the at least one shelf fixture is in removable electrical contact with the second electrically conductive support standard of the second upright subassembly.

In another aspect of the invention, the low voltage power supply is in electrical contact with the first electrically conductive support standard of the first upright subassembly and the second electrically conductive support standard of the second upright subassembly. Such that the system is configured to provide the electrical current to the LED array when the least one fixture is mounted to the first electrically conductive support standard of the first upright subassembly the second electrically conductive support standard of the second upright subassembly.

In another aspect of the invention, the first and second electrically conductive support standard each comprise a series of slots that are divided from one another by regularly spaced horizontal members. And, each shelf fixture further comprises a first electrically conductive arm extending rearwardly from the first end of the LED array and a second electrically conductive arm extending rearwardly from the second end of the LED array, each having an end that comprises a plurality of tabs configured to be received within the series of slots of the first and second electrically conductive support standards.

In another aspect of the invention, the system includes at least one LED illuminated header configured to be removably mounted to at least one of the support standards in each of the first and second upright subassemblies selected from the at least two spaced apart upright subassemblies, wherein the at least one LED illuminated header comprises an LED illuminated surface generally parallel to a longitudinal axis of the at least two spaced apart upright subassemblies.

Further aspects or embodiments of the present invention will become apparent from the ensuing description which is given by way of example only.

BRIEF DESCRIPTION OF THE DRAWINGS

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

Figure 1:
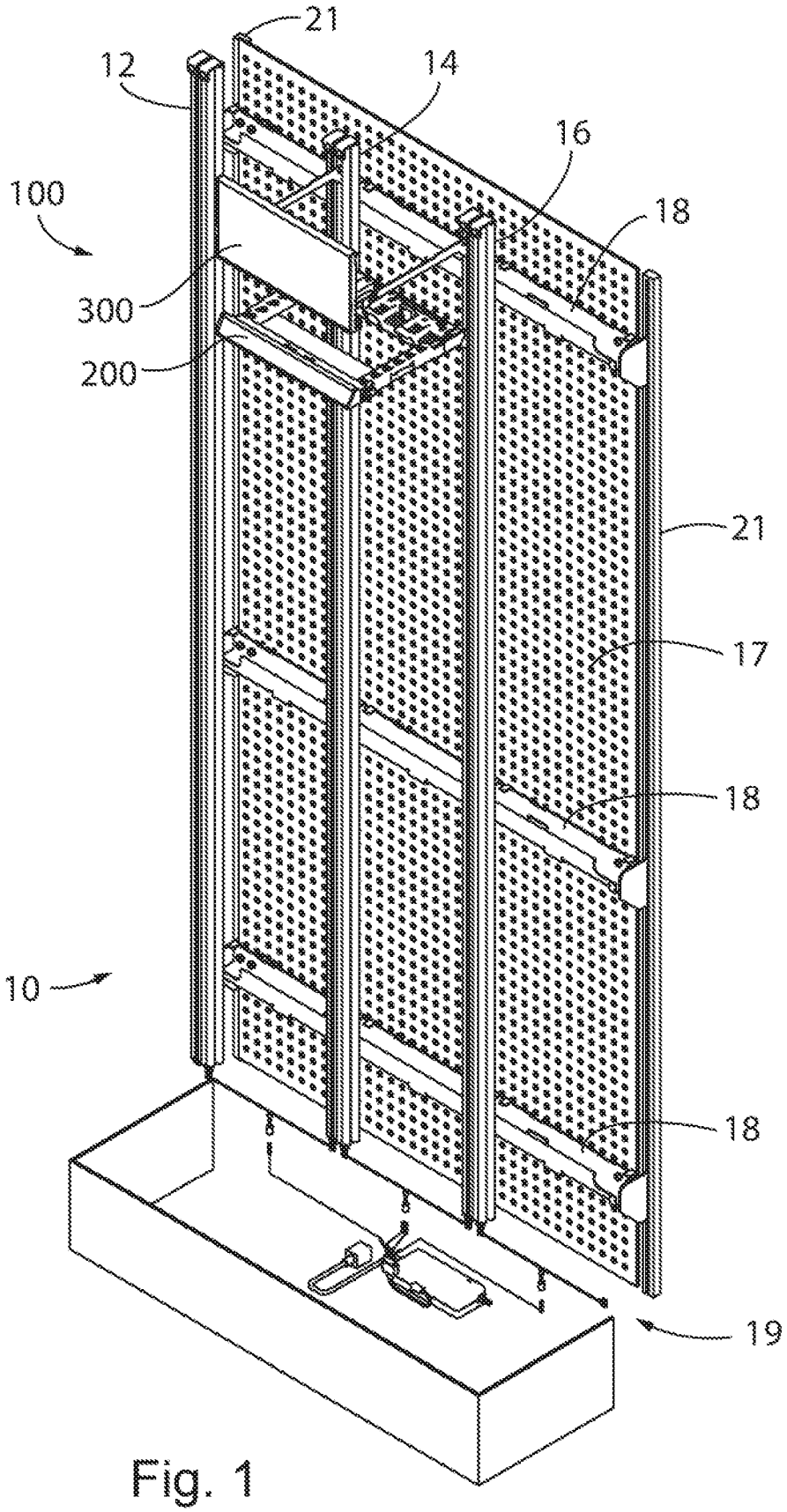
FIG. 1 is a front perspective view of a portion of the modular shelf system affixed to a pegboard containing support gondola in accordance with one embodiment of the present invention.

In describing the representative embodiments of the invention illustrated in the drawings, specific terminology will be resorted to for the sake of clarity. However, it is not intended that the invention be limited to the specific terms so selected and it is to be understand that each specific term includes all technical equivalents which operate in a similar manner to accomplish a similar purpose.

DETAILED DESCRIPTION OF THE DRAWINGS

The present invention and the various features and advantageous details thereof are explained more fully with reference to the non-limiting embodiments described in detail in the following description.

Referring initially to FIGS. 1-10, there is shown a modular wall assembly 10 that is a component of a shelf system 100, which will be described in further detail below. The wall assembly 10, in the illustrated embodiment includes a first upright 12, second upright 14, and a third upright 16. However, it is considered well within the scope of this invention that the shelf system 10 may include two or more uprights sufficient to provide structural support for shelves and other fixtures placed thereon as will be described in further detail below. Each of the adjacent uprights 12, 14, 16 are supported by a hanger 18, which is hung onto a rear support surface such as pegboard 17 mounted to a gondola 19. The hanger 18 may extend between adjacent vertical supports 21 of the gondola 19. Again, while FIG. 1 illustrates each of the adjacent uprights 12, 14, 16 supported by three (3) hangers 18 that are dispersed along the vertical height of the respective uprights 12, 14, 16 any number of hangers 18 are considered to be well within the scope of this invention.

Still referring to the shelf system 100 in FIG. 1, a first fixture, namely a representative shelf 200, which may also be referred to as a tray or carrier tray and is described in further detail below, is shown extending outwardly from the second upright 14 and the third upright 16 of the wall assembly 10. Additionally, an alternative fixture, identified herein as a header 300, which is similarly described in further detail below, is shown also extending outwardly from the second upright 14 and third upright 16 at a height above the shelf 200.

Figure 2:
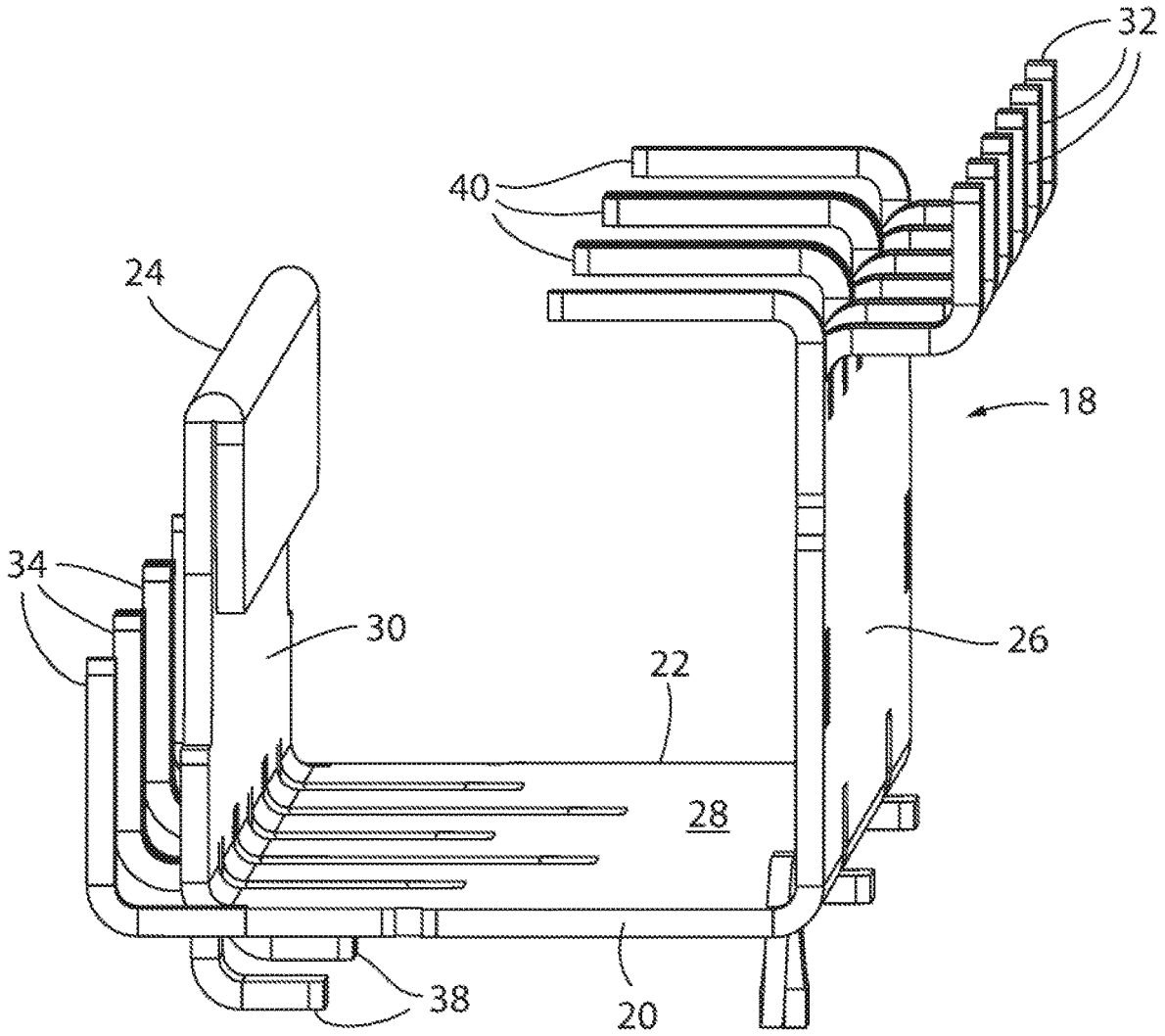
FIG. 2 is perspective side elevation view of a hanger bar configured to support a portion of the modular shelf system in accordance with one embodiment of the present invention.
Figure 3:
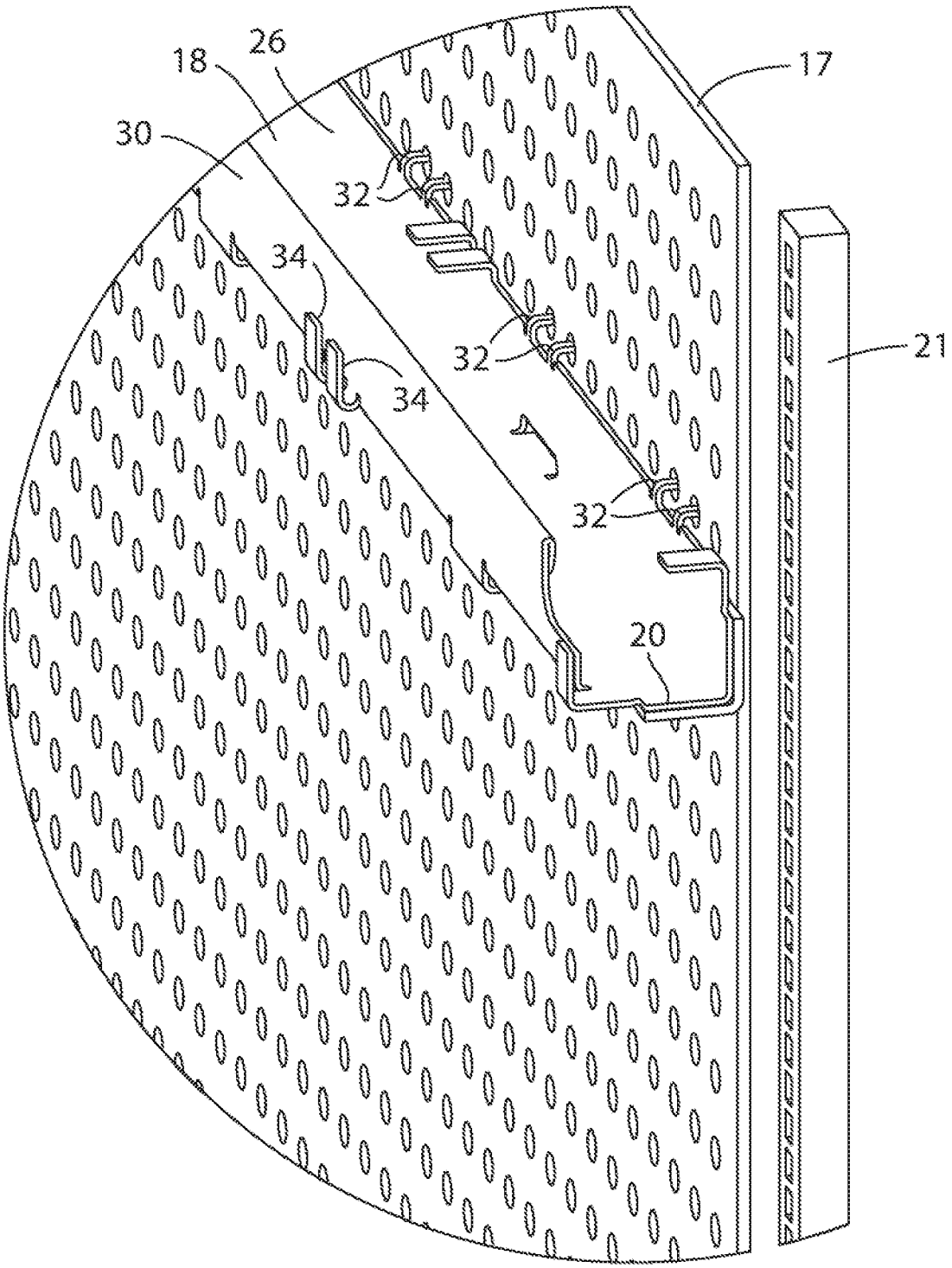
FIG. 3 is a detail perspective view of the hanger bar of FIG. 2 in a first configuration affixed to a pegboard containing support gondola in accordance with one embodiment of the present invention.

Turning now to FIGS. 2 and 3, the hanger 18, which supports the adjacent uprights 12, 14, 16, is shown in further detail. The hanger 18 includes a first end 20, an opposing second end 22 and a longitudinal length 24 extending between the first end 20 and second end 22. The hanger 18 is generally three-sided including a first side 26, a second side 28 that extends generally perpendicular to a bottom edge of the first side 26, and a third side 30 that extends upwardly from an opposed edge of the second side 28 and is generally parallel to the first side 26.

The hanger 18 may be secured to a gondola 19 or other rearwardly positioned supporting surface in one of three mounting configurations, and as such includes a multitude of mounting features to accommodate both the securing of the hanger 18, and its engagement with the uprights 12, 14, 16 of the modular wall assembly 10. More specifically, the hanger includes a first series of anchors 32 that extend upwardly from a top edge of the first side 26 and are configured to be received within the holes of the pegboard 17 rear support surface of the gondola 19, as was shown in FIG. 1. The first series of anchors 32 are generally set back rearwardly of the first side 26 of the hanger 18, such that when inserted into the holes of the pegboard 17, the rear surface of the first side 26 of the hanger 18 may generally engage the front surface of the pegboard 17. In this pegboard mounting configuration, a first series of mounting tabs 34 extends upwardly from the bottom edge of the third side 30 of the hanger 18 and are configured to receive and support the uprights 12, 14, 16 of the modular wall assembly 10, as will be described in further detail below. As shown in FIGS. 2 and 3, the first series of mounting tabs 34 are generally spaced forwardly of the front surface of the third side wall 30, such that the rear surface of the uprights 12, 14, 16 may slide between the first series of mounting tabs 34 and the front surface of the third side wall 30 of the hanger 18.

Figure 4:
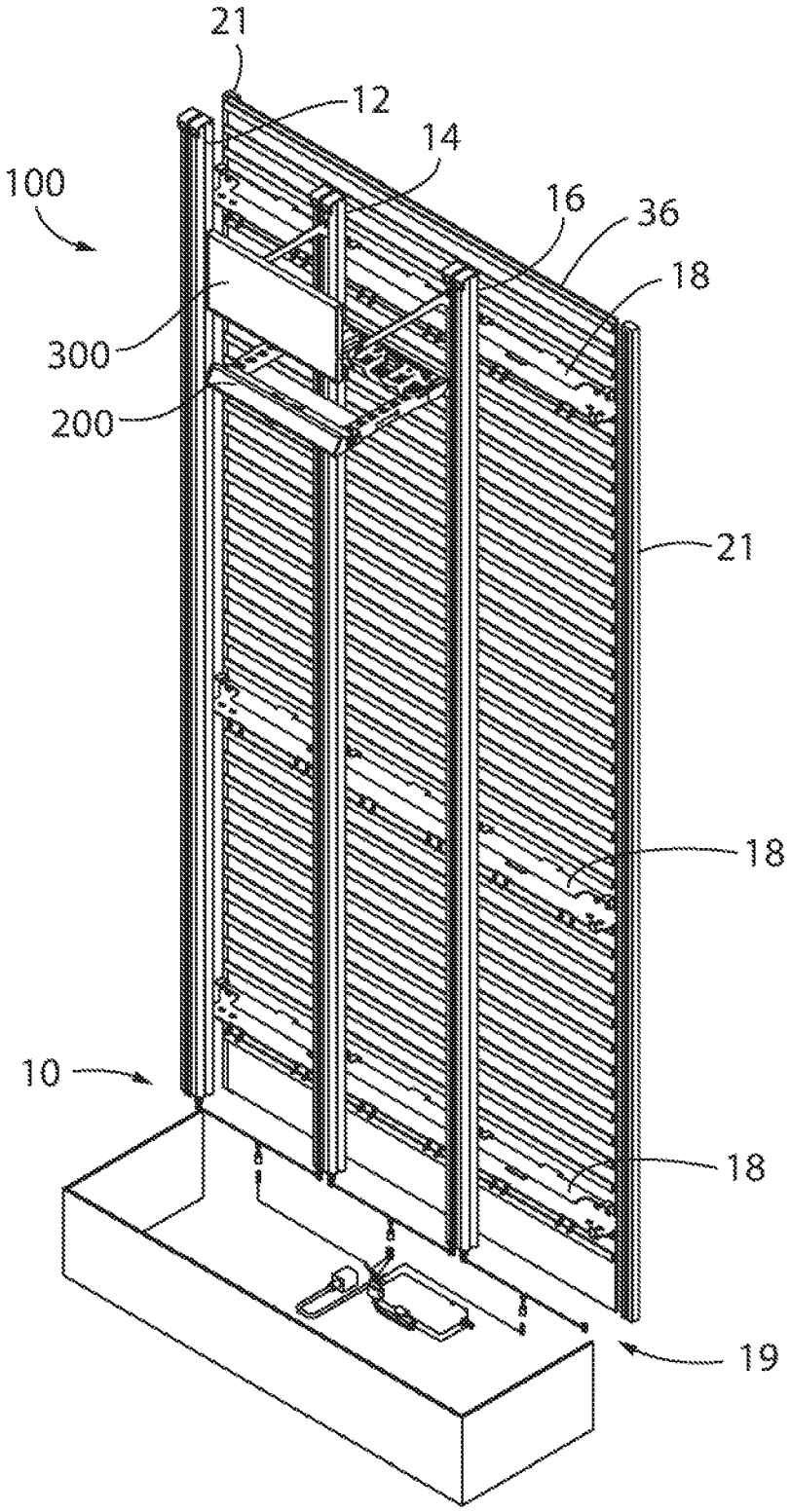
FIG. 4 is a front perspective view of a portion of the modular shelf system of FIG. 1 affixed to a slatwall containing support gondola in accordance with one embodiment of the present invention.
Figure 5:
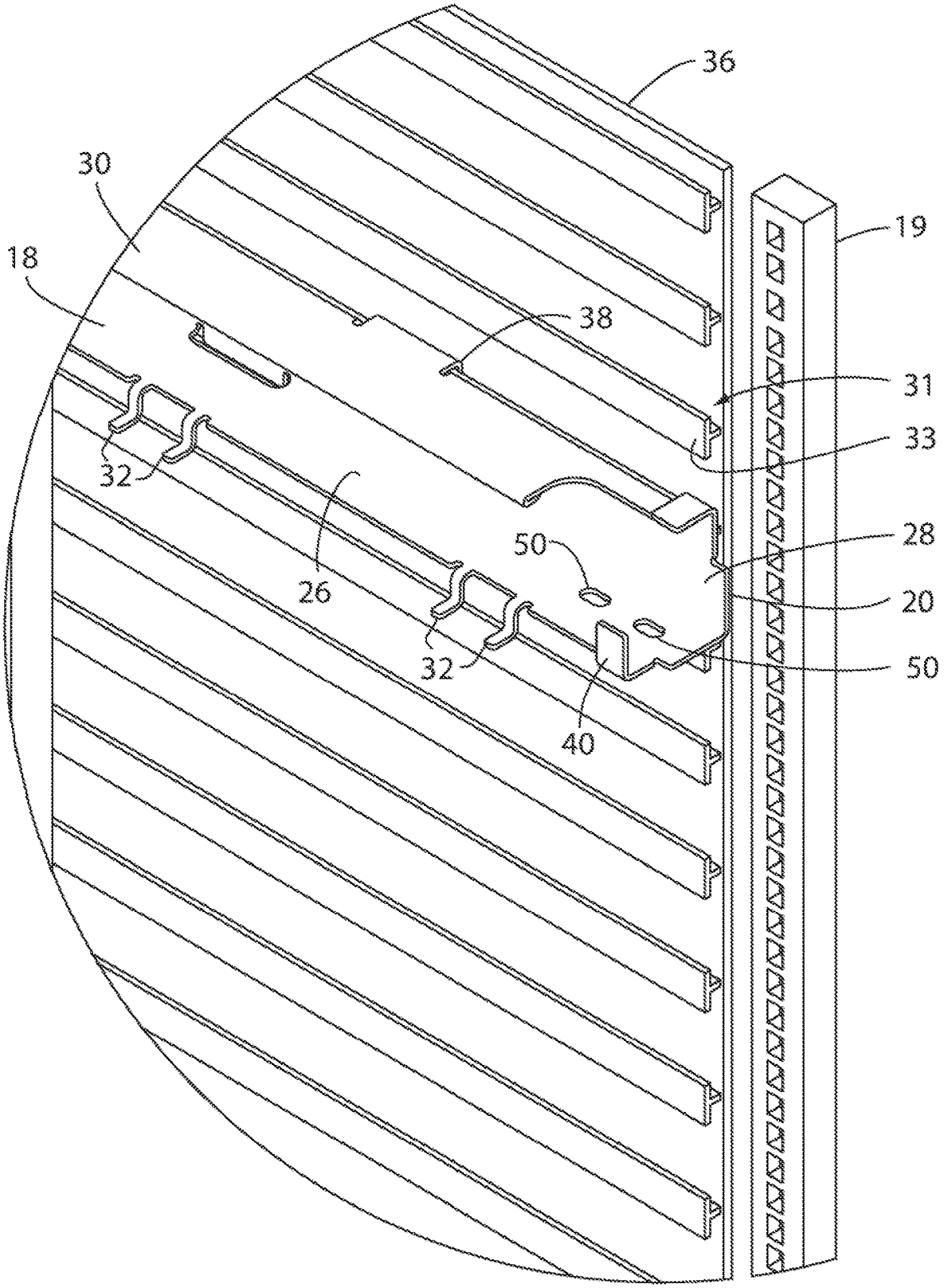
FIG. 5 is a detail perspective view of the hanger bar of FIG. 2 in a second configuration affixed to a slatwall containing support gondola in accordance with one embodiment of the present invention.

Still referring to FIG. 2, the hanger 18 may also be affixed to a gondola 19 that does not include a pegboard 17 rear surface but rather includes a slatwall 36 rear surface. In the slatwall mounting configuration, the hanger 18 will be rotated so that the outer surface of the second side 28 contacts the front surface of the slatwall 36, and the third side 30 of the hanger 18 is generally positioned above the first side 26. In this slatwall mounting configuration, the hanger 18 includes a second series of anchors 38 that extend outboard and generally parallel to the second side 28 and extend from the edge at second side 28 which joins the third side 30. The second series of anchors 38 are configured to be received within the horizontal groves 31 behind the slats 33 of the slatwall 36 rear support surface of the gondola 19, as is shown in FIGS. 4 and 5. The second series of anchors 38 are generally offset from the outer surface of the second side 28 of the hanger 18, such that when inserted into the slatwall 36, the outer surface of the second side 28 of the hanger 18 may generally engage the front surface of the slatwall 36, which is located forwardly of the recessed groves 31 of the slatwall 36. In the slatwall mounting configuration, a second series of mounting tabs 40 extends perpendicularly from the outer edge of the first side 26 of the hanger 18 and are configured to receive and support the uprights 12, 14, 16 of the modular wall assembly 10, as will be described in further detail below. As shown in FIGS. 2, 4 and 5, the second series of mounting tabs 40 are generally spaced forwardly of the outer edge of the first side wall 26, such that the rear surface of the uprights 12, 14, 16 may slide between the second series of mounting tabs 40 and the outer edge of the first side wall of the hanger 18.

Figure 6:
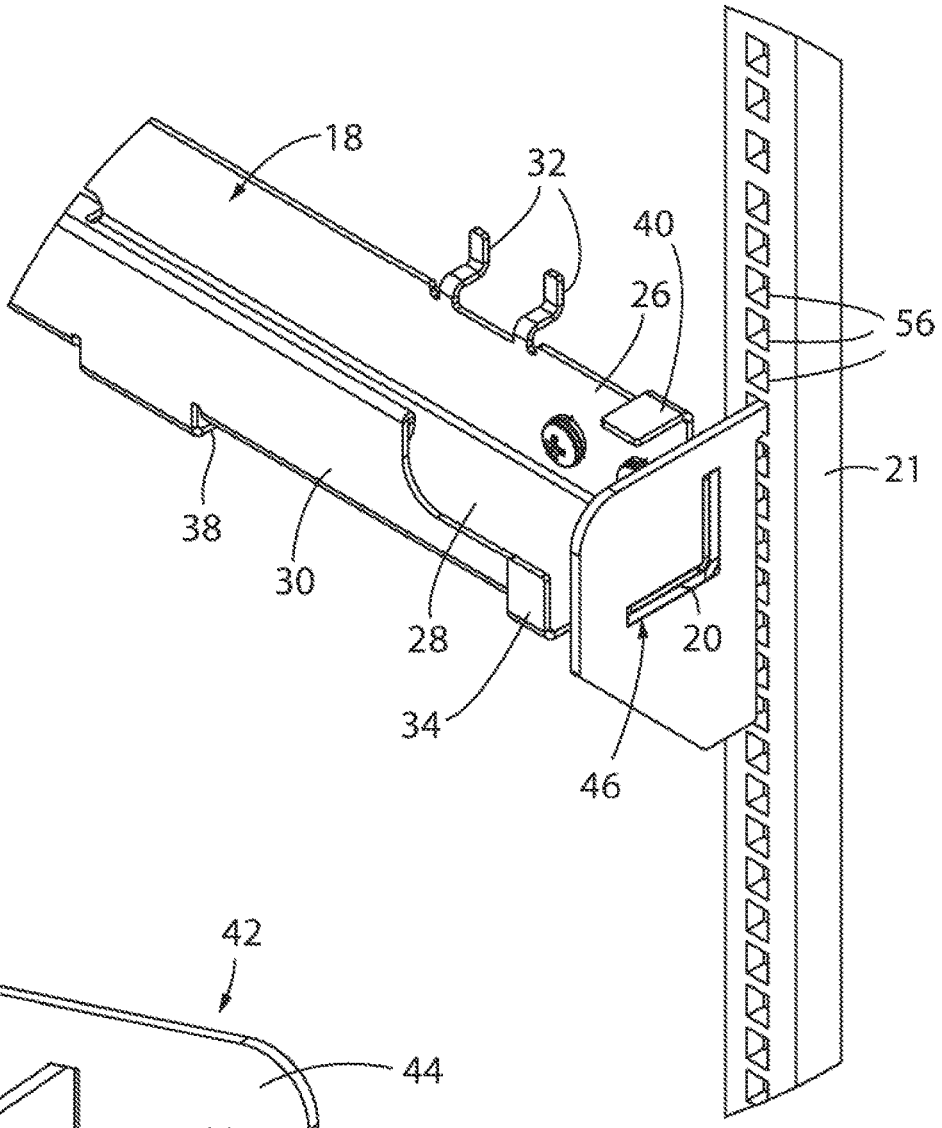
FIG. 6 is a detail perspective view of the hanger bar of FIG. 2 in a third configuration affixed to a vertical upright of a support gondola in accordance with one embodiment of the present invention.
Figure 7:
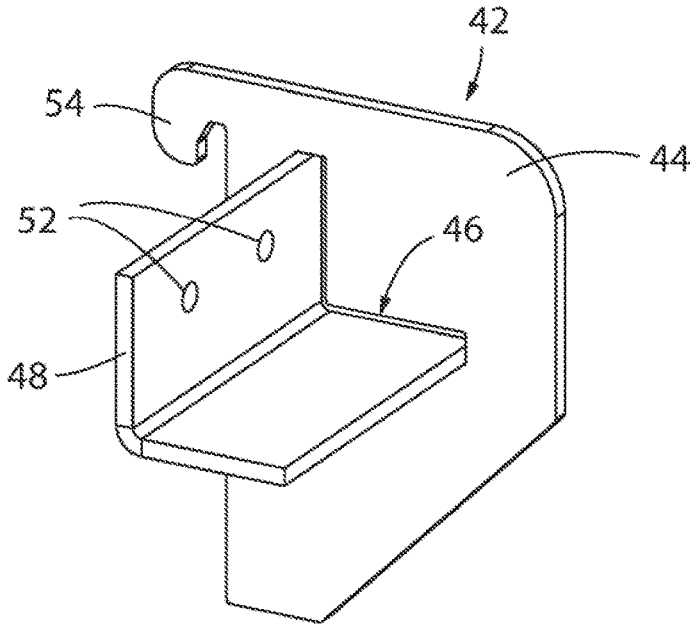
FIG. 7 is a perspective view of the hanger bar bracket in accordance with one embodiment of the present invention.
Figure 8:
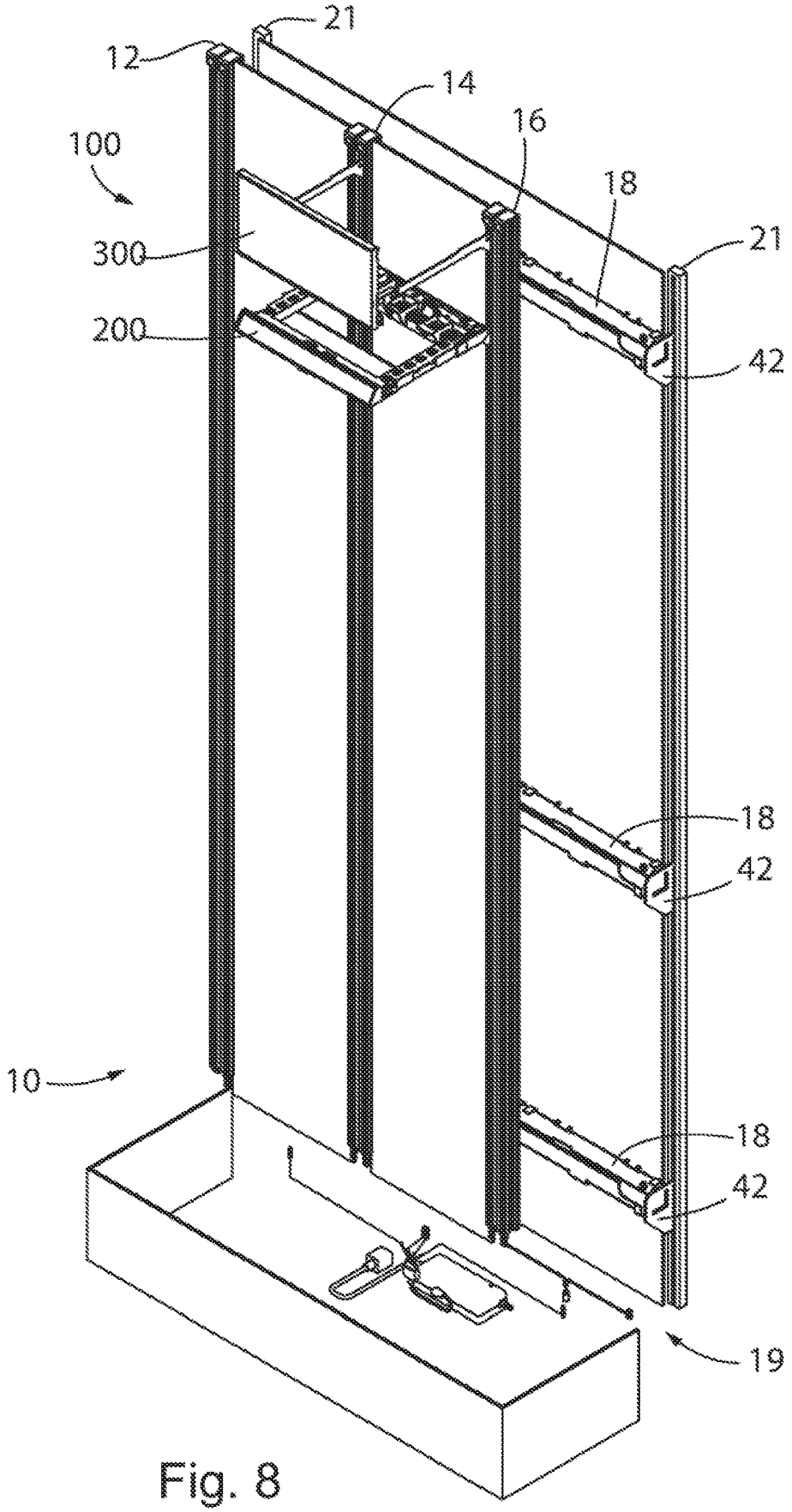
FIG. 8 is a front perspective view of a portion of the modular shelf system affixed to a support gondola in accordance with one embodiment of the present invention including wall panels positioned between adjacent uprights.
Figure 9:
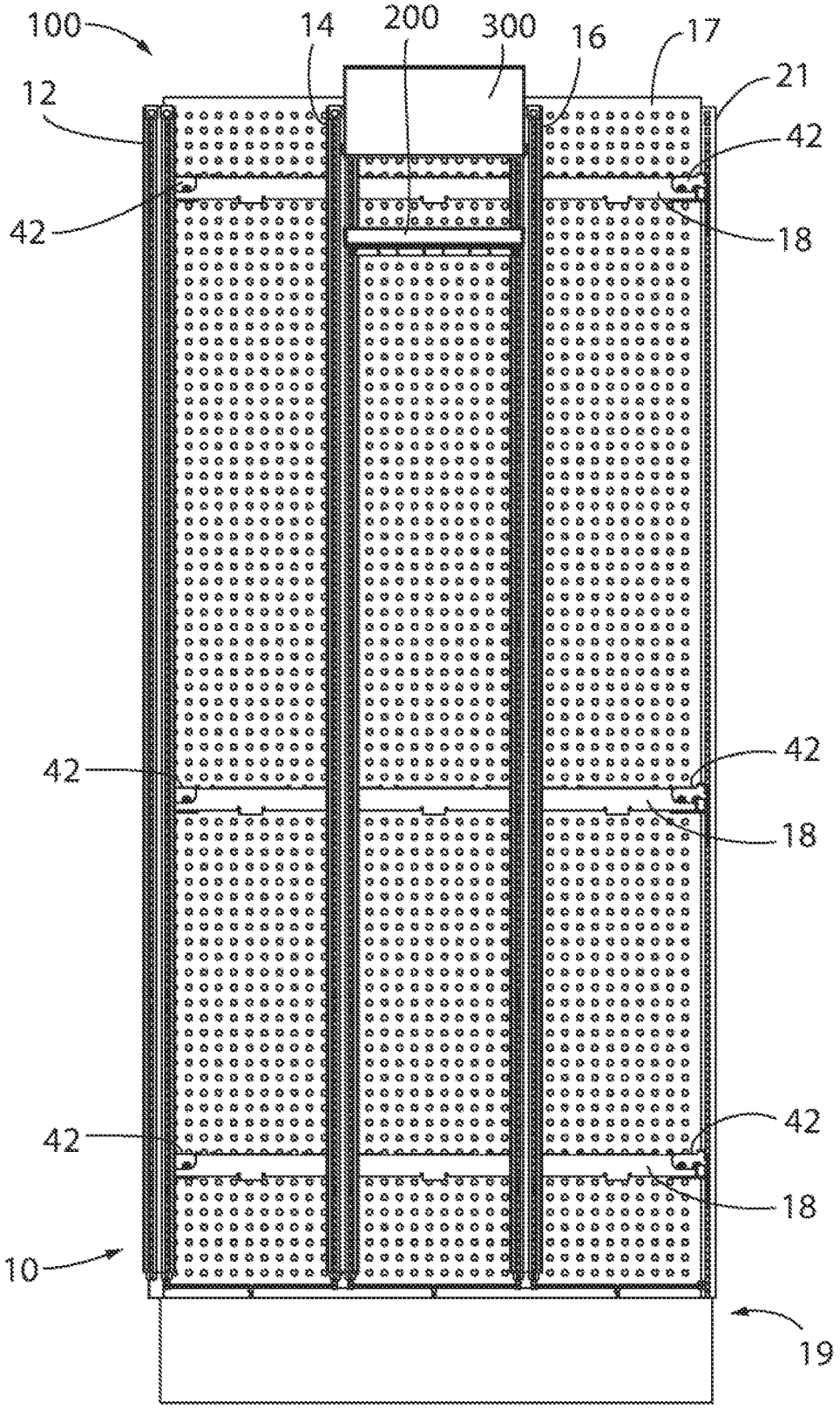
FIG. 9 is a front elevation view of the modular shelf system of FIG. 1.

Turning now to FIGS. 6-9, the hanger 18 may also be affixed to a gondola 19 that does not include a pegboard 17 rear surface or a slatwall 36 rear surface. Rather, by way of affixing a mounting bracket 42 to the opposing first end 20 and second end 22 of the hanger 18, the hanger 18 may be affixed directly to the vertical supports 21 of the gondola 19. It should also be noted that the hanger 18 may be affixed in this manner, i.e., directly to the vertical supports 21 of the gondola 19, if a slatwall 36 or pegboard 17 rear surface were present as is shown in FIG. 9. While FIGS. 6 and 7 show a mounting bracket 42 affixed to the first end 20 of the hanger 18, a mirror image mounting bracket (not shown) is also configured to engage the second end 22 of the hanger 18. The mounting bracket 42 generally includes a mounting plate 44 with an L-shaped slot 46 for receiving the first end 20 of the hanger 18 therein. An L-shaped support 48 extends perpendicular to the plate 44 and engages the outer surfaces of the first and second sides 26, 28 of the hanger 18 when the first end 20 is received in the slot 46. A series of apertures 50 adjacent the first side 26 at the first end 20 of the hanger 18 overlap a series of apertures 52 in support 48 such that fasteners can pass through both apertures 50 and 52 to securely affix the bracket 42 to the hanger 18. Once securely affixed, a rearwardly extending tab 54 of the plate 44 is placed into a desired slot 56 in the vertical supports 21 of the gondola 19 to mount the hanger 18. As this mounting bracket configuration is oriented similarly to the pegboard mounting configuration, the first series of mounting tabs 34, which extends upwardly from the bottom edge of the third side 30 of the hanger 18 are utilized to receive and support the uprights 12, 14, 16 of the modular wall assembly 10, as was shown generally in FIGS. 1 and 3.

Figure 10:
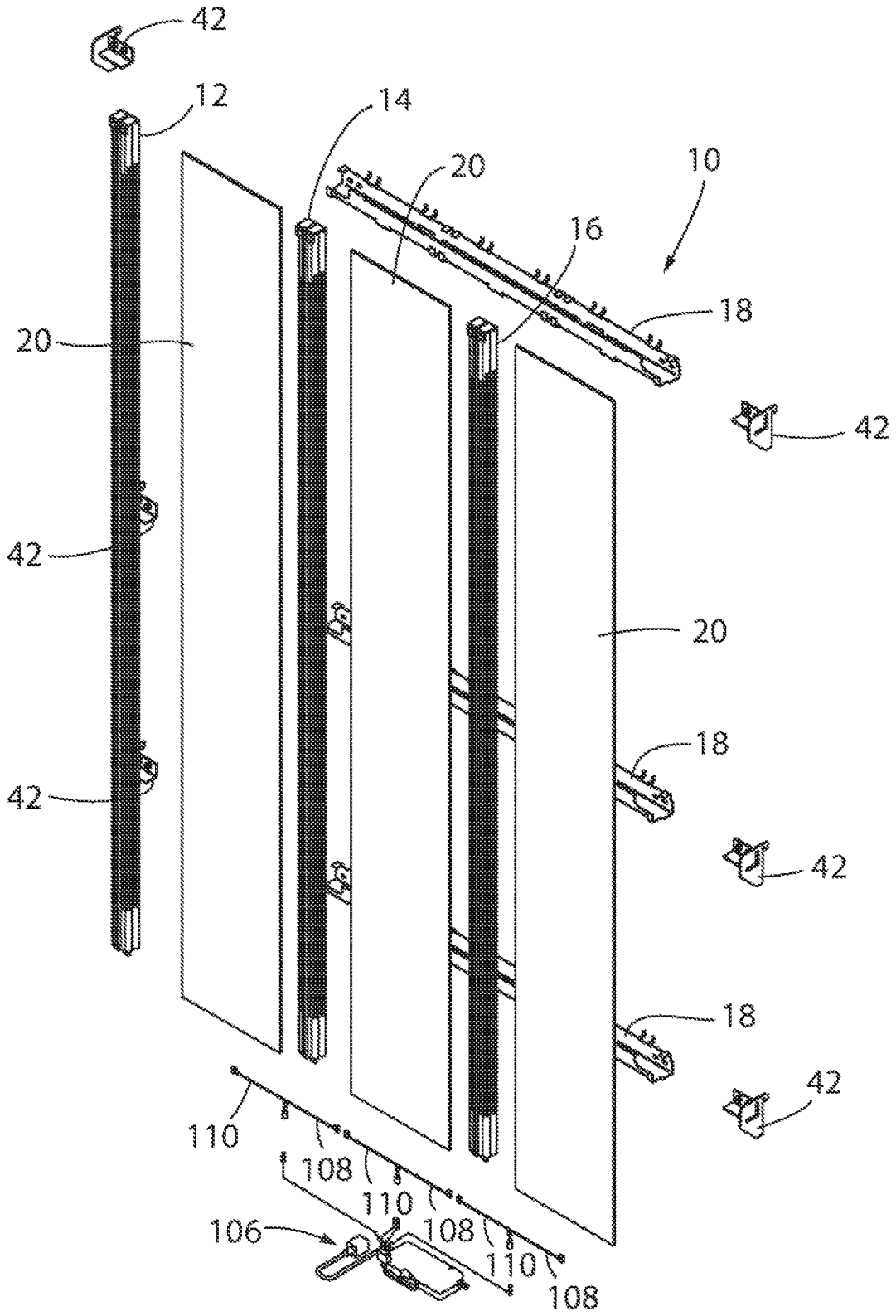
FIG. 10 is a front perspective exploded view of a portion of the modular shelf system shown in FIG. 1.

Turning now to FIG. 10, in one embodiment of the modular wall assembly 10 that is a component of the shelf system 100, a wall panel 20 may be shown extending between each of the adjacent uprights 12, 14, 16. For example, three wall panels 20 are shown in FIG. 10; however, it is understood that more panels may be present in an embodiment of the modular wall assembly 10 that includes more adjacent uprights, 12, 14, 16. The wall panel 20 may engage and be retained within grooves of the adjacent uprights 12, 14, 16 thereby functioning as a privacy panel to conceal or screen the underlying hangers 18, brackets 42 pegboard 17, and/or gondola structure 19 from view. In one embodiment of the present invention, the wall panel 20 may be formed of plastic, however alternative materials such as metal, paper, or combinations thereof are considered well within the scope of the present invention. Furthermore, while FIG. 10 shows the wall panels 20 having a width of approximately 12 inches, it should be understood that the present invention is not so limited, and the by placing adjacent uprights 12, 14, 16 at various distanced from one another, the width of the wall panel 20 may be adjusted, either greater than or less than 12 inches to accommodate the span between adjacent uprights 12, 14, 16. Similarly, as will be described in more detail below, the height of the wall panel 20 may be adjusted to accommodate, i.e., match the selected height of the adjacent uprights.

Figure 11:
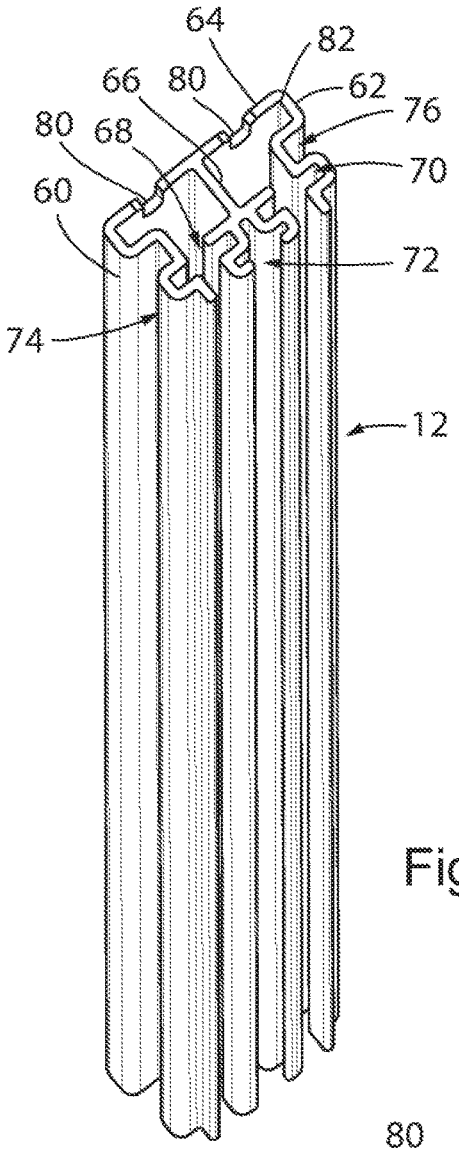
FIG. 11 is a front perspective of an upright portion of the modular shelf system shown in FIG. 1.
Figure 12:
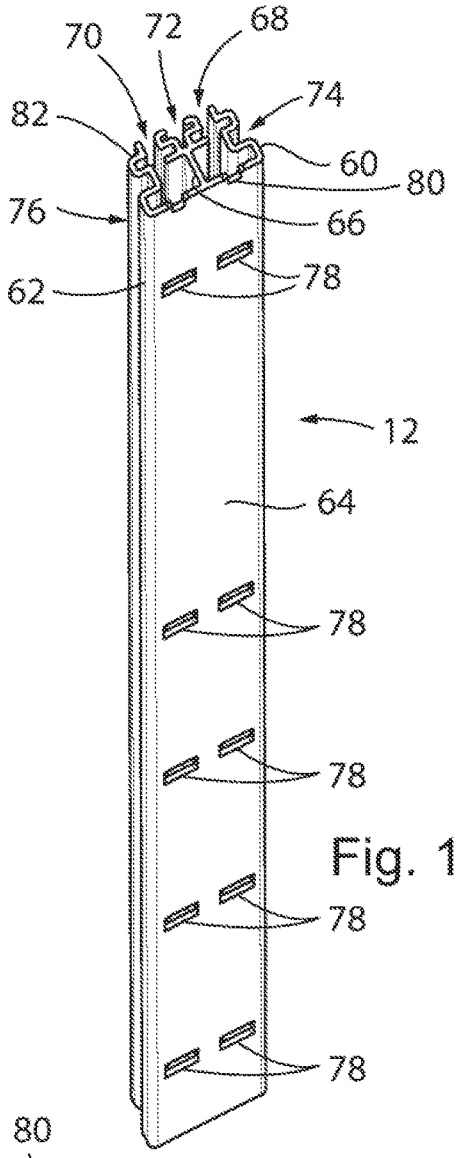
FIG. 12 is a rear perspective of the upright shown in FIG. 11.
Figure 13:
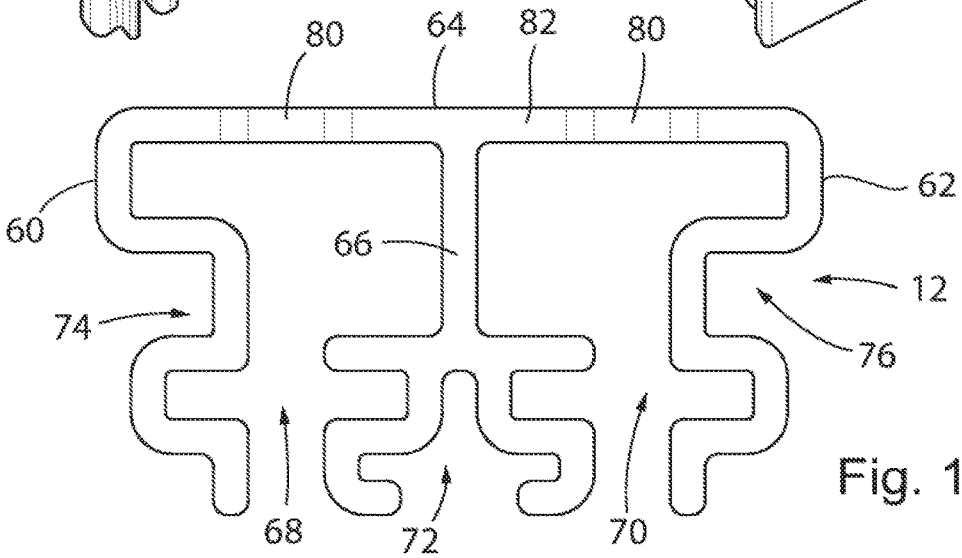
FIG. 13 a top plan view of the upright shown in FIG. 11.

Turning now to FIGS. 11-13, the upright 12, as a representative example of one of the various uprights 12, 14, 16 of the wall assembly 10, will be described in further detail. The upright 12 is an elongated element that is preferably formed of a non-conductive material such as a plastic or resin that may be formed via extrusion or similar manufacturing techniques. The upright 12 includes a first side 60, an opposing second side 62, a rear wall 64 extending between the first side 60 and the second side 62, and a middle wall 66 extending from approximately a midpoint of the rear wall 64, between the first and second sides 60, 62. A first support channel 68 is disposed between the first side 60 and the middle wall 66 and an adjacent second support channel 70 is disposed between the second side wall 62 and the middle wall 66. A flared end of the middle wall 66 defines a centrally positioned location identified channel 72 that is generally positioned at a midpoint of the upright 12 and in front of the first and second support channels 68, 70. Each of the vertically oriented channels 68, 70, 72 are formed of grooves in the respective adjacent side walls 60, 62, 66, that extend the height of the upright 12, with a front surface of the respective channels 68, 70, 72 remaining open as shown in FIGS. 11-13. The outer side surface of the first side wall 60 further defines a first wall panel retention groove 74 while the opposing outer side surface of the second side wall 62 defines a second wall panel retention groove 76. In use, when multiple uprights 12, 14, 16, etc. are positioned adjacent one another, as shown in FIG. 10, the first wall panel retention groove 74 of one upright 14 will align with the second wall retention groove 76 of the adjacent upright 12, such that the wall panel 20 may be retained therein between multiple adjacent uprights 12, 14, etc. It should be understood that the width of the wall panel retention groove 74, 76 is approximately equal, i.e., plus or minus 5 mm, to the thickness of the wall panel 20, such that the wall panel 20 will be securely retained within the adjacently positioned grooves 74, 76.

Turning now to FIG. 12, the rear wall 64 of the upright 12 is shown including a series of spaced apart mounting apertures 78. The top most apertures 78 define a pair of cap fixation slots 80 recessed into the top edge 82 of the upright 12 and are configured to receive a fastener to affix a upright cap as will be described in further detail below. The apertures 78 are configured to receive and hang from either the first or second series of mounting tabs 34, 40 of the hanger 18 depending upon the selected mounting configuration of the hanger 18. When the upright 12 is positioned between adjacent uprights 12, 14, 16, etc. in an elongated segment of the wall assembly 10, one of the mounting tabs 34, 40 located at an end 20 a first hanger 18 may engage the aperture 78 located at the edge of the first side wall 60 of the upright 12, while simultaneously a one of the mounting tabs 34, 40 located at an end 22 of a second hanger 18 may engage an adjacent aperture 78 located at the edge of the second side wall 62. That is to say that the dual adjacent apertures 78 provides mounting locations for two adjacent hangers 18 such the upright can span two adjacent hangers 18 during assembly of the wall assembly 10. Alternatively, when the upright 12 is located at an end of a wall assembly 10, such as is shown in FIG. 1, the mounting tab 34, 40 located at the exposed end 20, 22 of the hanger 18 may be placed in either of the two adjacent apertures 78 such that the upright 12 is spaced in the desired horizontal location within the wall assembly 10 generally, and to appropriately conceal the exposed end 20, 22 of the hanger 18. If need be the width of the wall panel 20 may be adjusted, i.e., trimmed, to accommodate the variable positioning of the upright 12 located at the end of the wall assembly 10.

Figure 16:
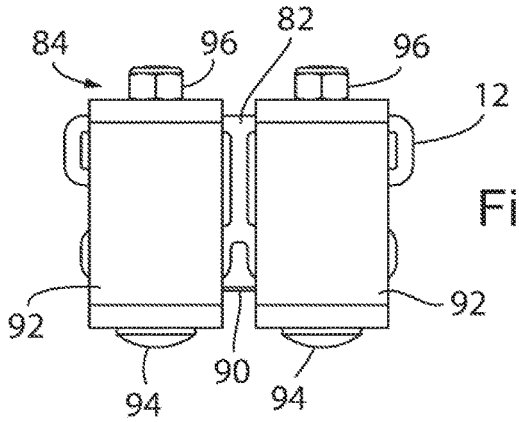
FIG. 16 is a top plan view of the upright subassembly of FIG. 14.
Figure 15:
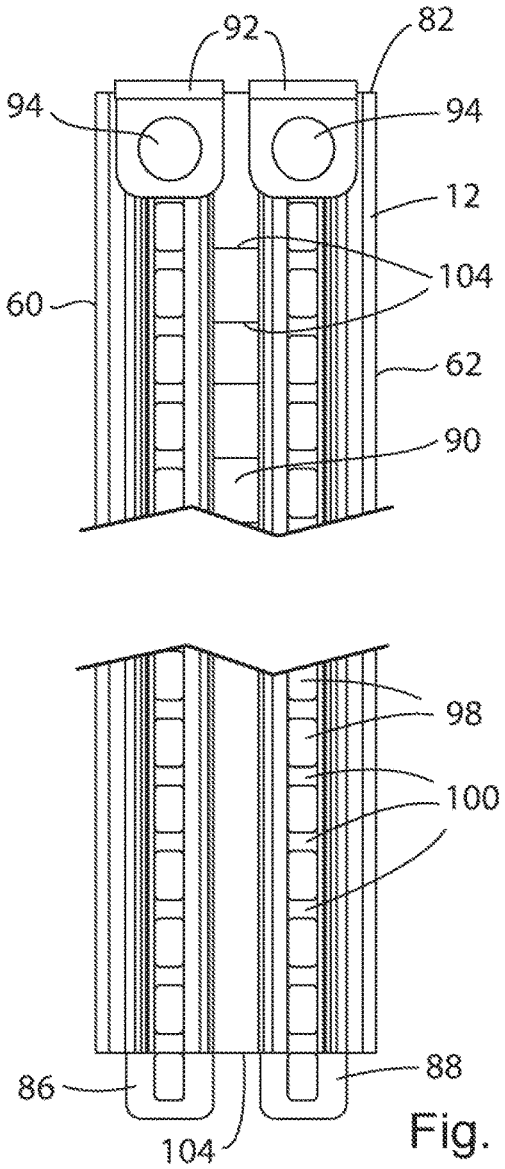
FIG. 15 is a front view of the upright subassembly of FIG. 14.
Figure 14:
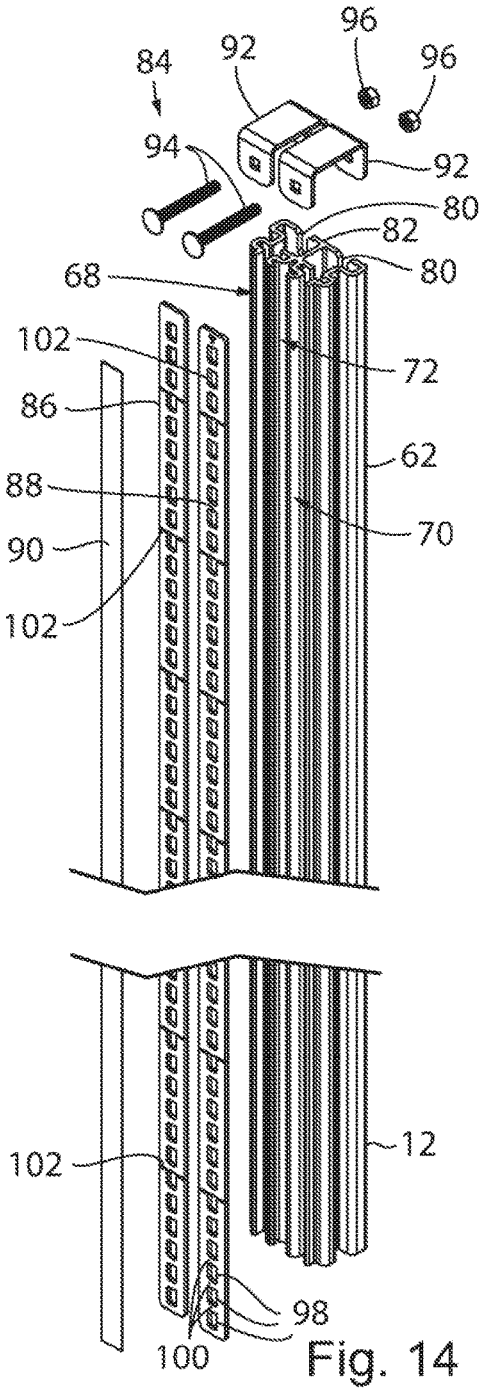
FIG. 14 is an exploded front perspective view of an upright subassembly portion of the modular shelf system shown in FIG. 1.
Figure 17:
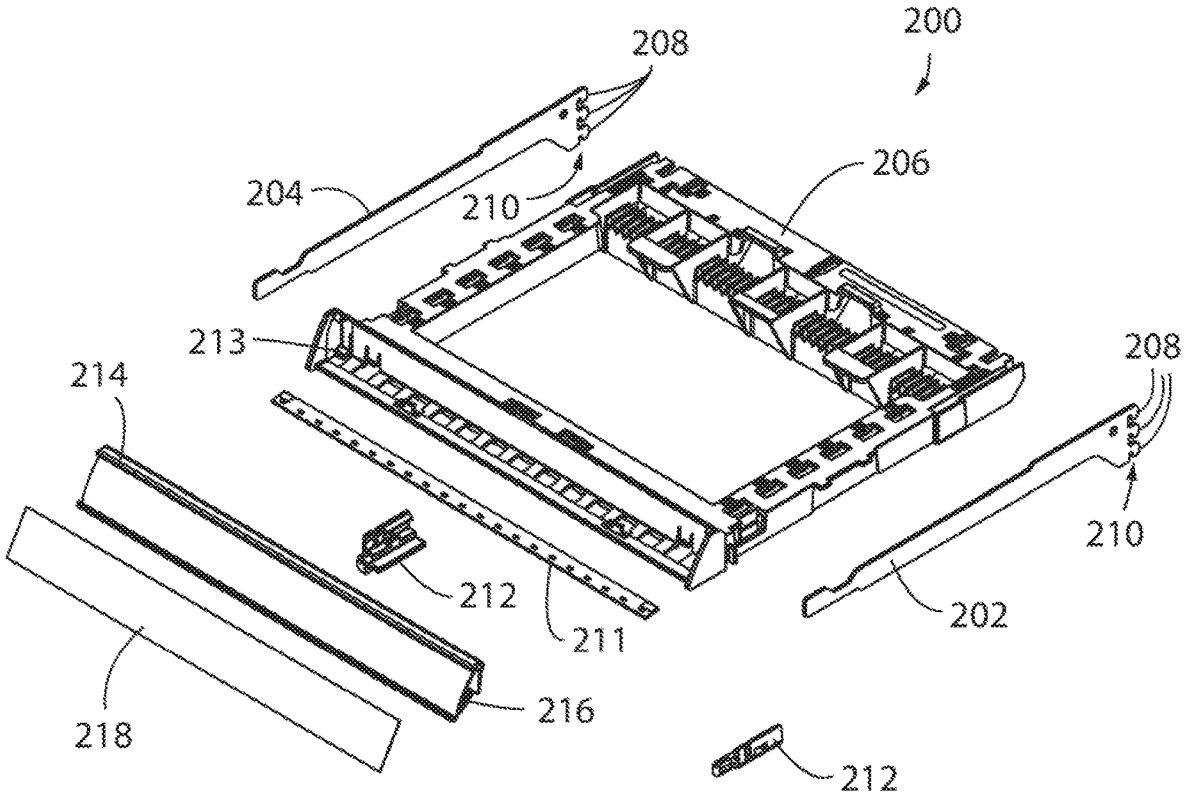
FIG. 17 an exploded front perspective view of a shelf fixture of the modular shelf system shown in FIG. 1.
Figure 18:
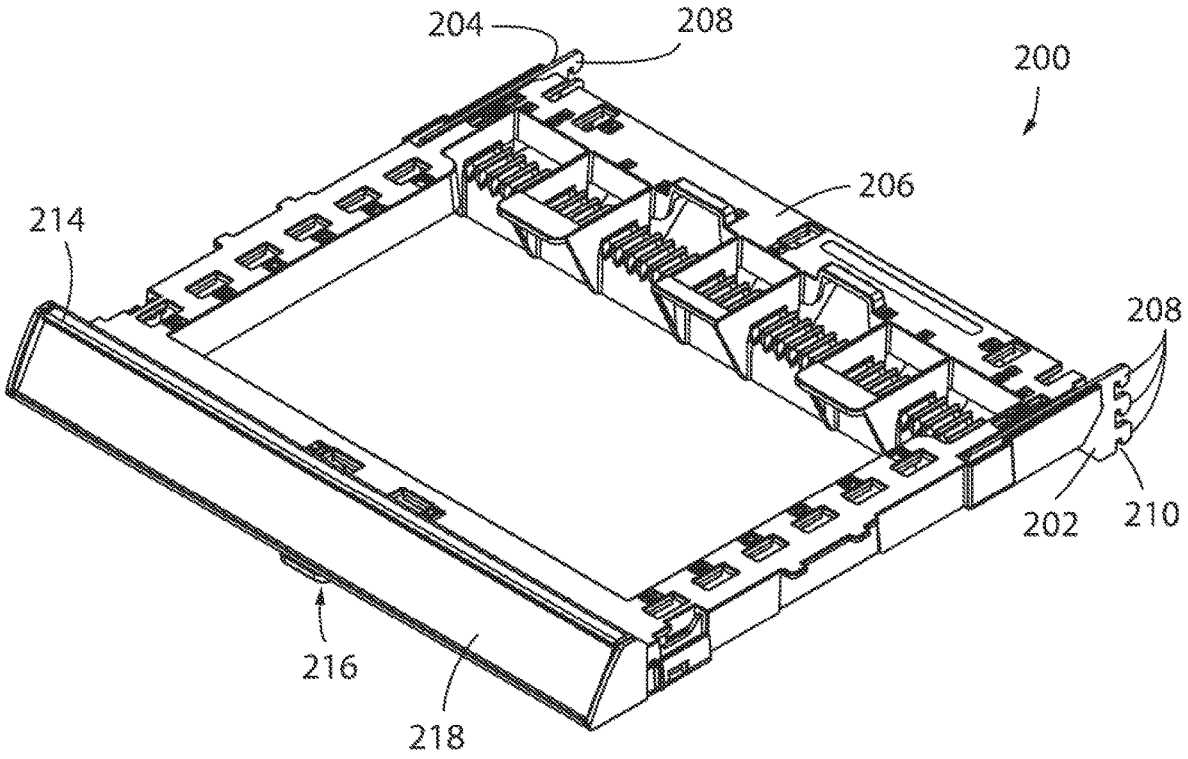
FIG. 18 is a front perspective view of the shelf fixture of the modular shelf system shown in FIG. 17.

Turning now to FIGS. 14-16, the upright 12 will be further described within the context of an upright subassembly 84. Each upright subassembly 84 of the wall assembly 10 includes a single upright 12, as was described above, a first support 86 disposed within the first support channel 68, a second support 88 disposed within the second support channel 70, a location identification guide 90 disposed within the location identification channel 72, a pair of caps 92 extending over a top edge 82 of the upright 12 and its respective support channels 68, 70 and retained therein by a threaded fastener or bolt 94 and threaded nut 96.

The first and second supports 44, 46 are formed of an electrically conductive material such as a metal alloy that is well configured for both bearing the weight of fixtures such as shelves 200 and headers 300, and retail products mounted thereon as well as conducting low voltage electrical current as will be described in further detail below. The supports 44, 46 are generally flattened and elongated such that during assembly they may be slid into the respective support channels 30, 32 of the upright 12 from the top edge 82 of the upright 12. A series of slots 98 that are divided from one another by regularly spaced horizontal members 100 extend along the length of each support 44, 46, akin to later rungs, which are adapted to receive and physically engage the shelves 200 and headers 300, as to provide both weight bearing support and an electrical connection with the shelves 200 and headers 300, as will be described below.

Furthermore, multiple height reduction embossings, such as a grove 102 are formed into the supports 86, 88 at regular intervals along the height of the supports 86, 88. The grove 102 denotes an area of latitudinally localized weakness in the support 86, 88, that is well suited for bending, resulting in the controlled breakage of the support 86, 88 at the location of the grove 102. That is to say, in use, the height of the supports 86, 88 may be reduced to accommodate a particularly desired height, such as during installation applications and without the use of cutting tools. Once the desired height of the conductive supports 86, 88 are achieved by selective means of controlled breakage at the groves 102, the conductive supports 86, 88 are slid into their respective channels 68, 70 in the upright 12. If need be, the height of the upright 12 and or the height of the location identification guide 90 may also be reduced to accommodate the desired height of the upright subassembly 84, with the use of a hand saw, hand sheers or similar cutting implement or tool. The conductive supports 86, 88 are affixed to the upright 12 by means of passing a fastener 94, such as a bolt or shaft though the top most slot 98 of each conductive support 86, 88 and through the rear wall slot 80 in the 64 of the upright 12. A locking fastener 96 may securely retain the conductive supports 86, 88 and upright 12 in this configuration while a cap 92 may also be retained over the top of the upright 12 by way of threading the fastener 94, as seen in FIG. 14. Also affixed within the upright 12 is the location identification guide 90 that is disposed within the location identification channel 72 between and in front of the two conductive supports 86, 88. While not shown in FIG. 14, but shown in FIG. 15, the location identification guide 90 may be graduated, which is to say that it includes a series of horizontal lines 104 or alternative indicia that correspond to the position of the slots 98 in the adjacent conductive supports 86, 88. The horizontal lines 104 on the location identification guide 90 may be marked with numbers, letters or the like (not shown) to assist a user in properly identifying corresponding slots 98 of equal relative height when installing shelves 200 and headers 300. That is to say that use of the location identification guide 90 will assist in hanging the shelves 200 and headers 300 in a substantially flat or horizontal orientation and prevent improperly installing shelves 200 and headers 300 at undesirable angles.

Once the upright subassembly 42 has been assembled, as is shown in FIGS. 15 and 16, each conductive support 44, 46 will extend below the bottom edge 104 of the upright 12. Returning briefly to FIG. 10, in one embodiment of the present invention, in which the shelves 200, headers 300, and/or alternative fixtures are illuminated by LEDs, a low voltage electrical current of approximately 24V travels from a power source 106, which may be a low voltage power converter. It should be understood that in an alternative embodiment, the electrical current may be less than or equal to 48V, preferably less than or equal to 24V and in one embodiment 12V is considered well within the scope of the current invention. Exposure of the conductive standards 86, 88 provides a contact surface for engagement with a first electrical conductor 108 via a conductive fastener that extends from the power source 60 and a second electrical conductor 110 via conductive fastener that returns to the power source 106. That is to say that the low voltage current is provided from the power source 106 to the first electrical conductor 106, which is affixed to the exposed lower end of the first conductive standard 86 of an upright 14. The second conductive standard 88, that is located in an adjacently positioned upright 12 is then electrically connected to the second electrical conductor 108 at the exposed lower end of the second conductive standard 88, which then returns to the power source 106. The electrical circuit is then completed between the first conductive standard 86 of the first upright 14 and the second conductive standard 88 of the adjacent second upright 12, by passing the current through an LED array equipped shelf 200 or header 300, which spans from the first upright 14 to the second upright 12, as will be described in further detail below. That is to say that the electrical circuit utilizes one conductive standard 86, 88 from one upright subassembly 84 and one conductive standard 86, 88 from an adjacently positioned upright subassembly 84.

It should be understood that while the electrical conductive standards 86, 88 of the upright subassemblies 84 are configured to provide an electrical current to fixtures such as shelves 200 and headers 300 that include LEDs, or other electrical components, the present invention is not limited to an embodiment that requires electrification of the shelf system 100. That is to say that one aspect of the present invention is directed to a shelf system 100 that may or may not be electrified.

As was previously described above, once the individual upright subassemblies 84 have been assembled, they are configured to be hung on a wall or alternative vertical support surface. In one embodiment of the present invention, hangers 18 are utilized to support or hang the upright subassemblies 84 onto the pegboard 17, slatwall 36, or directly to the vertical uprights 19 of a gondola 19. Although it should be understood that the present invention does not require the use of hangers 18, underlying pegboard 17, slatwall 36 or gondolas 19.

While the shelf system 100 as shown in FIGS. 1, 4 and 8-10 illustrates a wall assembly 10 in which adjacent upright subassemblies 84 are positioned at a distance of approximately 12 inches from one another, it should be understood that the present invention is not so limited. By way of providing a hanger 18, or similar support apparatus, that has a relatively longer or shorter length, the horizontal spacing of the upright subassemblies 84 may be correspondingly vary. For example, for use in foreign markets that utilize SI units, the hangers 18 may have a length that accommodates standard upright subassemblies 84 intervals of a fraction of a meter, rather than approximately 12 inches. Similarly, in embodiments of the present invention in which the length of the hanger 18 has been altered, so too will the corresponding length of the wall panel 20, as was previously described, and which are configured to slide into the grooves 74, 76 of adjacent uprights 12, 14, 16.

Turning now to FIGS. 17-20, a shelf 200 according to one embodiment of the present invention will be described in further detail. The shelf 200 includes a first arm 202 and second arm 204 and a shelf support structure 206 disposed between the arms 202, 204. The first and second arms 202, 204 are formed of an electrically conductive material such as a metal alloy that is well configured for both bearing the weight of shelves 200, any tray set thereon and retail merchandise as well as conducting a low voltage electrical current received from the conductive standards 86, 88. Each arm 202, 204 includes a plurality of tabs 208 extending perpendicular relative to the length of the arms 202, 204. The tabs 208 are removed a distance from the end of the arms 202, 204 to form a receiving area 210 between each tab 208 and the end of the respective arm 202, 204. When mounted on the shelf system 100 as seen in FIGS. 1, 4, 8 and 9, one or more the tabs 208 from the first arm 202 are inserted into the slots 98 in the first conductive standard 86 of an upright assembly 84, while the one or more the tabs 208 from the second arm 204 are inserted into the slots 98 in the second conductive standard 88 of an adjacent upright assembly 84. The shelf 200 is then pressed down, such that horizontal members 100, which divide the adjacent slots 98 on the conductive standards 86, 88 are received within the receiving areas 210 and both the tabs 208 and the end of the corresponding arms 202, 204 engage opposing sides of the horizontal member 100. In this mounted configuration the shelf 200 is now structurally supported on the conductive standards 86, 88 that are affixed within their respective uprights 12. Additionally, the contact between the electrically conductive standards 86, 88 and the electrically conductive arms 202, 204 allows a low voltage current to travel through the arms 202, 204 and into an LED array 211 that is positioned between the arms 202, 204 at a front edge of the shelf support structure 206. The LED array 211 which is preferably affixed to a printed circuit board that is retained within the from the shelf 200 by opposing electrically conductive clips 213, which may be electrically connected to the arms 202, 204 via opposing contact clips 212, which slide over the respective front ends of the arms 202, 204 thereby completing the electrical circuit. Accordingly, when the shelf 200 is mounted on the conductive standards 86, 88 an electrical circuit is formed in which a current is provided by the power supply 106, travels through the first conductor 108, first conductive standard 86, first shelf arm 202, clip 212, and LED array 211, and then back through the opposing clip 212, second shelf arm 204, second conductive standard 88 and the second conductor 110. While only one shelf 200 is shown mounted to the shelf system 100 in FIGS. 1-4, a plurality of shelves 200 are configured to be mounted to the shelf system 100 simultaneously.

Additionally, the shelf 200 may include a light diffuser 214 for directional control and diffusion of the light emitted from the LEDs in the LED array 211, a concealed signage storage 216, and or an exposed signage surfaces 218 at the front edge of the shelf support surface 206. The concealed signage storage 216 provides a location for UPC and or other product information storage, and the exposed signage surface 218 provides an exposed surface for product information that can be easily read by a customer. In use, the diffuser 214, storage 216 and surface 218 may rotatably attach to the front end of the shelf support surface 206 to provide ease of access. Additionally, the shelf support surface 206 may be a frame that is configured to receive various retail product storage and display members thereon. In a preferred embodiment of the present invention, the shelf support surface is generally a universal frame that accommodates integration with various retail product storage and display members. The shelf support surface 206 and it various components may be formed of a molded plastic or other nonconductive material such that they provide electrical insulation along length of the arms 202, 204 that are affixed to or within the shelf support surface 206.

Figure 19:
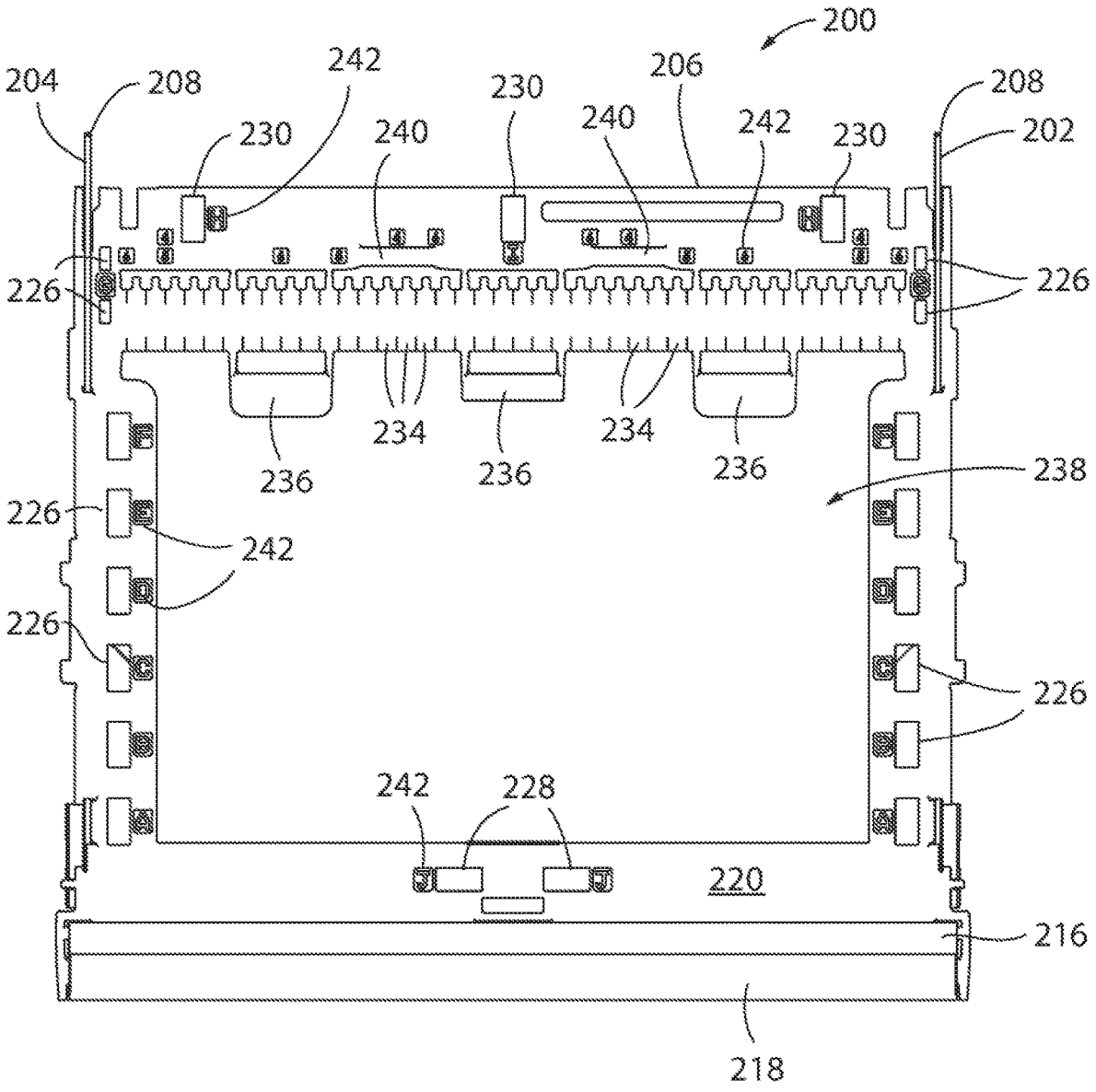
FIG. 19 is a top plan view of the shelf fixture of the modular shelf system shown in FIG. 17.
Figure 20:
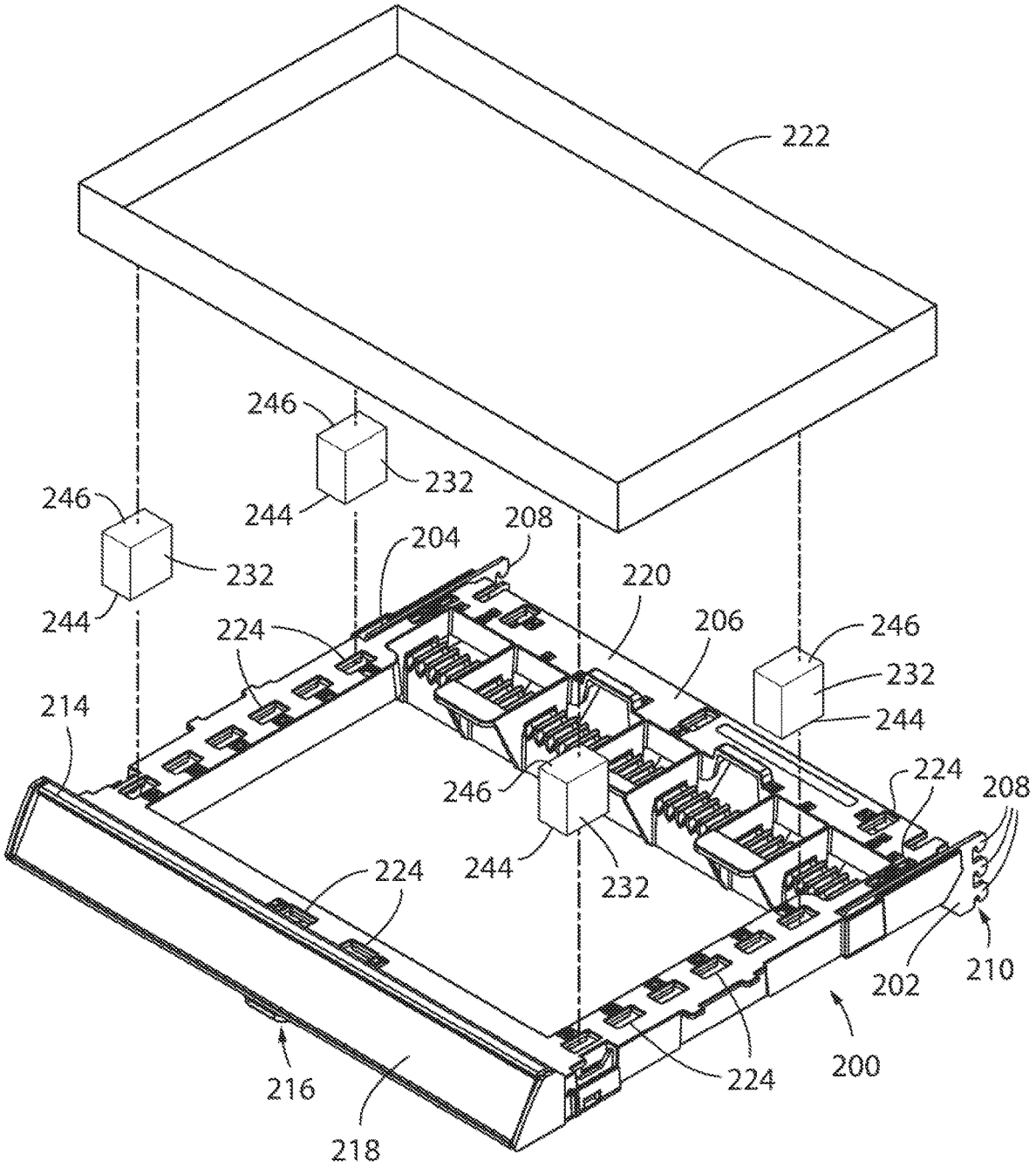
FIG. 20 is an exploded front perspective view of the shelf fixture of the modular shelf system shown in FIG. 17 including a plurality of fasteners and an insert tray received thereon; and, FIG. 21 is an exploded front perspective view of a second shelf fixture of the modular shelf system shown in FIG. 1.

Referring now to FIG. 20, the carrier tray, i.e., shelf 200, of system 100 includes between arms 202, 204 a shelf support surface 206 that may be a frame that is configured to receive various retail product storage and display members, i.e. insert trays 222, on the upper surface 220 of the support surface 206. The insert trays 222 in one embodiment of the present invention are well suited for displaying small retail products such as cosmetics for purchase. In a preferred embodiment of the present invention, the shelf support surface 206 is generally a universal frame that accommodates integration with various insert trays 222, i.e., retail product storage and display members. The shelf support surface 206 and its various components may be formed of a molded plastic or other nonconductive material such that they provide electrical insulation along length of the arms 202, 204 that are affixed to or within the shelf support surface 206. Still referring to FIG. 20, and as shown in more detail in FIG. 19, the upper surface 220 of the support surface 206 may include a plurality of mounting slots 224 disposed about the perimeter of the support surface 206. In one illustrative embodiment of the present invention, the support surface 206 may include eight side mounting slots 226 disposed along the length of each arm 202, 204, two mounting slots 228 disposed at a front edge of the support surface 206 that retains the LED array 211, and three mounting slots 230 disposed at a rear edge of the support surface 206 opposite the LED array containing front edge. Of course, it should be understood that any number of mounting slots 224 and locations of said mounting slots 224 are within the scope of the present invention. Furthermore, as shown in FIGS. 19 and 20 all mounting slots 224 need not have the same shape, such that the slots 224 may receive and retain fasteners 232 of many different configurations as will be described below. Additionally, as shown in FIGS. 19 and 20 the rear edge of the support surface 206 opposite the LED array containing front edge may include a plurality of hanging bar attachment points 234 extending between the first and second arms 202, 204, configured to accommodate removable bars for hanging products below the support surface 206 of the shelf 200 and/or insert tray 222. Additionally, a plurality of support platforms 236 may extend upwardly from the rear edge of the support surface 206 opposite the LED array containing front edge, and over the centrally located void 238 in the support surface 206, as to provide addition structural support or anchoring locations for the insert tray 222. Finally, the rear edge of the support surface 206 opposite the LED array containing front edge may also contain a plurality of raised rigid or fixed anchoring catch 240 for receiving a portion of an insert tray 222 therein. As shown in FIG. 19 the various mounting slots 224, hanging bar attachment points 234, support platforms 236, anchoring catches 240 may be associated with individual alphanumerical character identifying indicia 242, as to facilitate assembly of the shelf 200 with fasteners 232 and inserts trays 222 as described below.

Returning now to FIG. 20, there is shown a representative example of four fasteners 232 configured to engage four mounting slots 224 within the support surface 202 and the insert tray 222. By way of a representative example fastener 232, includes a lower mounting portion 244, which is configured to be securely received within a mounting slot 224 of the shelf 200. The faster 232 further includes, an opposing insert tray securing portion 246, which generally extends upwardly from the mounting portion 244. Generally, the mounting portion 244 may include one or more resilient members, which are configured to deflect upon insertion into the mounting slot 224, thereby forming a secure snap-fit engagement with the support surface 206. In one embodiment of the present invention, the various fasteners 224 may include mounting portions 244 of varying shape and configuration, such that they may be securely affixed to corresponding mounting slots of similarly varying shape and configuration. Similarly, the insert tray securing portion 246 of each fastener 232 may also exhibit a distinct shape and configuration. Accordingly, the fasteners 232 are configured to engage various surface structures of a desired insert tray 222, and securely retain the selected insert tray 222 to the carrier tray, i.e. shelf 200, either alone or in combination with one another. As such, the various fasteners 232 allows the system 100 to accommodate fastening a wide variety of insert tray shapes in a generally snap-fit configuration.

Figure 21:
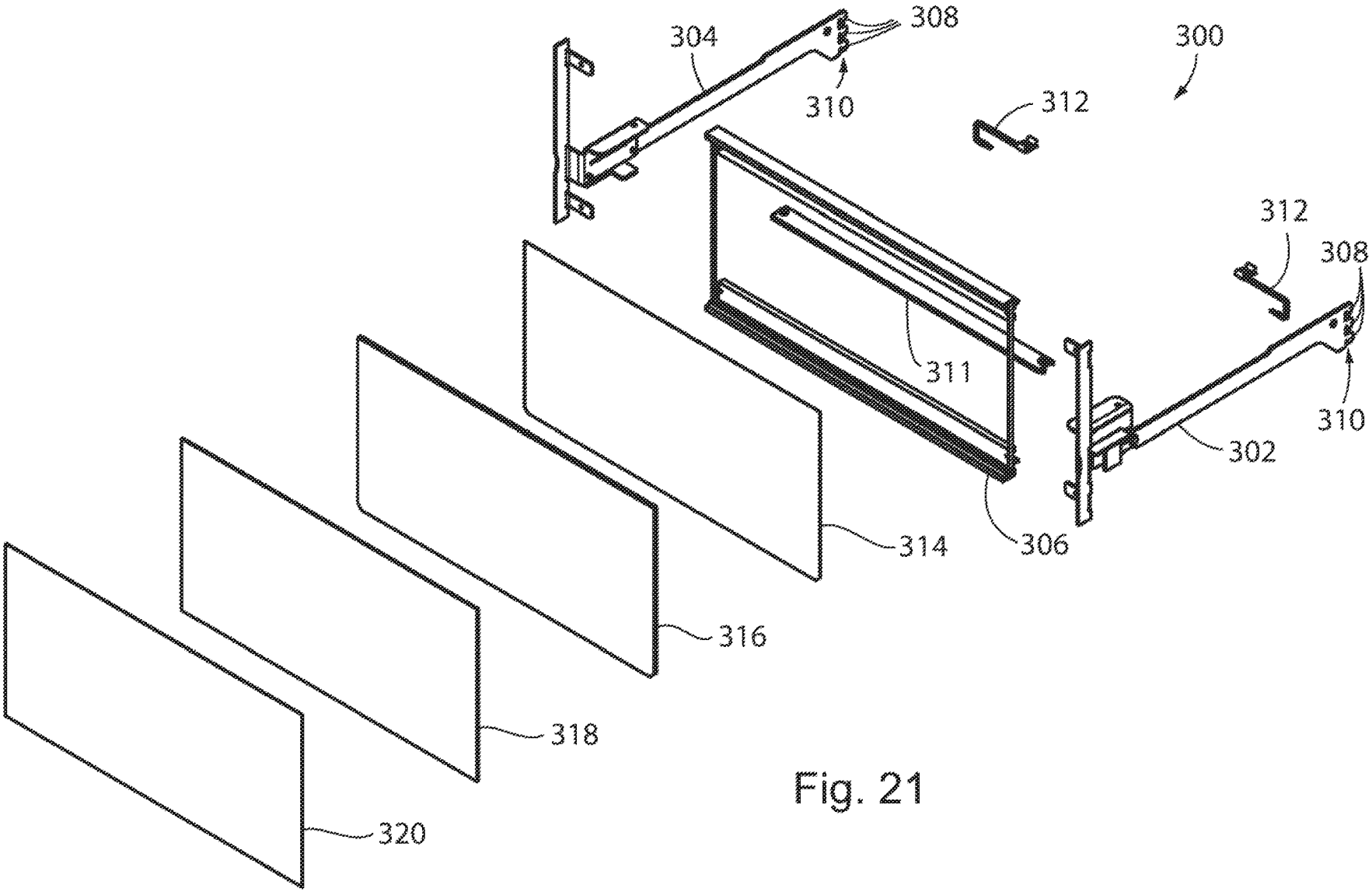

Turning now to FIG. 21, the header 300, or light box, will be described in further detail. The header fixture 300 is generally similar to the structure of the shelf fixture 200 described above, and also includes a first arm 302 and second arm 304. A light box housing 306 or frame extends between the arms 302, 304. The first and second arms 302, 304 are formed of an electrically conductive material such as a metal alloy that is well configured for both bearing the weight of header 300 as well as conducting a low voltage electrical current received from the conductive standards 86, 88. Each arm 302, 304 includes a plurality of tabs 308 extending perpendicular relative to the length of the arms 302, 304. The tabs 308 are removed a distance from the end of the arms 302, 304 to form a receiving area 310 between each tab 308 and the end of the respective arm 302, 304. When mounted on the shelf system 100 as seen in FIGS. 1, 4, 8 and 9 one or more the tabs 308, and preferably less than four tabs 308, from the first arm 302 are inserted into the slots 98 in the first conductive standard 86 of an upright assembly 84, while the one or more the tabs 308 from the second arm 304 are inserted into the slots 98 in the second conductive standard 88 of an adjacent upright assembly 84. The header 300 is then pressed down, such that horizontal members 100, which divide the adjacent slots 98 on the conductive standards 86, 88 are received within the receiving areas 310 and both the tabs 308 and the end of the corresponding arms 302, 304 engage opposing sides of the horizontal member 100. In this mounted configuration the header 300 is now structurally supported on the conductive standards 86, 88. Additionally, the contact between the electrically conductive standards 86, 88 and the electrically conductive arms 302, 304 allows a low voltage current to travel through the arms 302, 304 and into an LED array 311 that is positioned between the arms 302, 304 at an edge of the light box housing 306 to provide uplight or downlight across the front surface of the lightbox 300. The LED array 311 is electrically connected to the arms 302, 304 via opposing contact clips 312, which slide over the respective front ends of the arms 302, 304 thereby completing the electrical circuit. Accordingly, when the header 300 is mounted on the conductive standards 86, 88 an electrical circuit is formed in which a current is provided by the power supply 106, travels through the first conductor 108, first conductive standard 86, first header arm 302, clip 312, and LED array 311, and then back through the opposing clip 312, second header arm 304, second conductive standard 88 and the second conductor 108. While only one header 300 is shown mounted to the shelf system 100 in FIGS. 1, 4 8 an 9, a plurality of headers 300 are configured to be mounted to the shelf system 100 simultaneously.

Alternatively, in the header 300, or light box fixture, the LED array 311 may be positioned about the front surface, rather than in a single line of LEDs such that the entire surface of the outwardly facing front surface of the header 300 is illuminated. The header 300 may also include a frame 306 supporting a lens or diffuser 314 and/or a light guide 316 located between the LED array 311 and the outwardly facing front surface of the header 300, such that the light omitted from the LED array 311 is modified to better suit the particular printed matter 318 that may be displayed within or overly the front surface of the header 300, or under a clear cover 320. Additionally, the arms 302, 304 of the header may also be covered with a nonconductive coating to prevent the occurrence shorting the electrical circuit when the shelving display 100 is illuminated. Still further, in one alternative embodiment of the present invention, the header 300 may have a length greater than the distance between adjacent upright subassemblies 84, such that the header 300 spans over or past one or more upright subassmeblies 84. Such an embodiment would allow for a longer particular printed matter that may be displayed within or overly the front surface of the header 300.

As was previously stated, it should be understood that while the electrical conductive standards 86, 88 of the upright subassemblies 84, and the arms 202, 204, 302, 304 of the shelves 200 and headers 300 are configured to provide an electrical current to LEDs, or other electrical components, the present invention is not limited to an embodiment that requires electrification of the shelf system 100. That is to say that one aspect of the present invention is directed to a shelf system 100 that may or may not be electrified. According non-illuminated fixtures such as shelves, that are structurally supported by the standards 86, 88 but not electrified are considered well within the scope of the present invention.

Although the best mode contemplated for carrying out the present invention is disclosed above, practice of the above invention is not limited thereto. It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An illuminated low voltage modular shelf system, comprising:

at least two spaced apart upright subassemblies, each subassembly including an upright having a first electrically conductive support standard recessed within a first support standard channel of the upright and a second electrically conductive support standard recessed within a second support standard channel of the upright, wherein the first and second support standard channels are separated by a common wall of the upright;

at least one shelf fixture configured to be removably mounted to one of the support standards in each of a first and second upright subassemblies selected from the at least two spaced apart upright subassemblies;

an LED array disposed within the at least one shelf fixture receiving an electrical current from a low voltage power supply that is conducted to the at least one shelf fixture through the electrically conductive support standards.

2. The illuminated low voltage modular shelf system of claim 1, wherein the first support standard channel comprises a first opening extending along a front surface of the upright such that the first electrically conductive support standard recessed within a first support standard channel has an exposed front surface and;

wherein the second support standard channel comprises a second opening extending along the front surface of the upright such that the second electrically conductive support standard recessed within the second support standard channel has an exposed front surface.

3. The illuminated low voltage modular shelf system of claim 2, wherein a first end of the LED array disposed within the at least one shelf fixture is in removable electrical contact with the first electrically conductive support standard of the first upright subassembly and a second end of the LED array disposed within the at least one shelf fixture is in removable electrical contact with the second electrically conductive support standard of the second upright subassembly.

4. The illuminated low voltage modular shelf system of claim 3, wherein the low voltage power supply is in electrical contact with the first electrically conductive support standard of the first upright subassembly and the second electrically conductive support standard of the second upright subassembly, and wherein the low voltage power supply is configured to provide the electrical current to the LED array when the least one fixture is mounted to the first electrically conductive support standard of the first upright subassembly the second electrically conductive support standard of the second upright subassembly.

5. The illuminated low voltage modular shelf system of claim 4, wherein the first and second electrically conductive support standard each comprise a series of slots that are divided from one another by regularly spaced horizontal members.

6. The illuminated low voltage modular shelf system of claim 5, wherein at least one shelf fixture further comprises a first electrically conductive arm extending rearwardly from the first end of the LED array and a second electrically conductive arm extending rearwardly from the second end of the LED array, and wherein an end of each of the first and second electrically conductive arms comprise a plurality of tabs configured to be received within the series of slots of the first and second electrically conductive support standards.

7. The illuminated low voltage modular shelf system of claim 6, wherein the first and second electrically conductive support standards are configured to concurrently receive less than four tabs from each electrically conductive arm of the least one shelf fixture.

8. The illuminated low voltage modular shelf system of claim 7, wherein the least one shelf fixture has an upper surface comprising a plurality of mounting slots configured to receive a plurality of tray mounting fasteners within the mounting slots in a snap-fit engagement, and a retail product display tray affixed to an opposing end of the fasteners.

9. The illuminated low voltage modular shelf system of claim 2, wherein the upright comprises a first slot disposed in a first outer side surface of the upright, a second slot disposed in a second outer side surface of the upright opposite the first outer side surface, and wherein the first and second outer side surfaces are generally perpendicular to the front surface of the upright.

10. The illuminated low voltage modular shelf system of claim 9, further comprising a wall panel extending between the first slot disposed in the first outer side surface of the first upright subassembly and the second slot disposed in the second outer side surface of the second upright subassembly.

11. The illuminated low voltage modular shelf system of claim 1, further comprising at least one LED illuminated header configured to be removably mounted to at least one of the support standards in each of the first and second upright subassemblies selected from the at least two spaced apart upright subassemblies, wherein the at least one LED illuminated header comprises an LED illuminated surface generally parallel to a longitudinal axis of the at least two spaced apart upright subassemblies.

12. The illuminated low voltage modular shelf system of claim 1, wherein each removable electrically conductive support standard includes a plurality of depressions spaced apart along a longitudinal axis of the support, and wherein each depression extends along the width of the support standard to provide an area of diminished structural integrity to facilitate controlled breakage of the support standard at a selected depression.

13. The illuminated low voltage modular shelf system of claim 12, wherein each depression is debossed into the electrically conductive support standard.

14. The illuminated low voltage modular shelf system of claim 1, where the electrical current is less than or equal to approximately 48 volts.

15. An illuminated low voltage modular shelf system, comprising:

at least two spaced apart upright subassemblies, each subassembly including an upright having a first electrically conductive support standard recessed within a first support standard channel of the upright and a second electrically conductive support standard recessed within a second support standard channel of the upright, wherein the first and second support standard channels are separated by a common wall of the upright;

at least one shelf fixture configured to be removably mounted to one of the support standards in each of a first and second upright subassemblies selected from the at least two spaced apart upright subassemblies;

an LED array disposed within the at least one shelf fixture;

a first end of the LED array disposed within the at least one shelf fixture is in removable electrical contact with the first electrically conductive support standard of the first upright subassembly and a second end of the LED array disposed within the at least one shelf fixture is in removable electrical contact with the second electrically conductive support standard of the second upright subassembly;

a power supply of less than or equal to 48 volts in electrical contact with the first electrically conductive support standard of the first upright subassembly and the second electrically conductive support standard of the second upright subassembly, configured to provide the electrical current to the LED array when the least one fixture is mounted to the first electrically conductive support standard of the first upright subassembly the second electrically conductive support standard of the second upright subassembly.

16. The illuminated low voltage modular shelf system of claim 15, wherein the first support standard channel comprises a first opening extending along a front surface of the upright such that the first electrically conductive support standard recessed within a first support standard channel has an exposed front surface and;

wherein the second support standard channel comprises a second opening extending along the front surface of the upright such that the second electrically conductive support standard recessed within a second support standard channel has an exposed front surface.

17. The illuminated low voltage modular shelf system of claim 15, wherein the first and second electrically conductive support standard each comprise a series of slots that are divided from one another by regularly spaced horizontal members.

18. The illuminated low voltage modular shelf system of claim 17, wherein at least one shelf fixture further comprises a first electrically conductive arm extending rearwardly from the first end of the LED array and a second electrically conductive arm extending rearwardly from the second end of the LED array, and wherein an end of each of the first and second electrically conductive arms comprise a plurality of tabs configured to be received within the series of slots of the first and second electrically conductive support standards.

19. The illuminated low voltage modular shelf system of claim 15, further comprising at least one LED illuminated header configured to be removably mounted to at least one of the support standards in each of the first and second upright subassemblies selected from the at least two spaced apart upright subassemblies, wherein the at least one LED illuminated header comprises an LED illuminated surface generally parallel to a longitudinal axis of the at least two spaced apart upright subassemblies.

20. An illuminated low voltage modular shelf system, comprising:

at least two spaced apart upright subassemblies, each subassembly including an upright having a first electrically conductive support standard recessed within a first support standard channel of the upright and a second electrically conductive support standard recessed within a second support standard channel of the upright, wherein the first and second support standard channels are separated by a common wall of the upright;

the upright of each upright subassembly further comprising:

the first support standard channel comprises a first opening extending along a front surface of the upright such that the first electrically conductive support standard recessed within the first support standard channel has an exposed front surface, and the second support standard channel comprises a second opening extending along the front surface of the upright such that the second electrically conductive support standard recessed within a second support standard channel has an exposed front surface;

at least one shelf fixture configured to be removably mounted to one of the support standards in each of a first and second upright subassemblies selected from the at least two spaced apart upright subassemblies;

an LED array disposed within the at least one shelf fixture;

a first end of the LED array disposed within the at least one shelf fixture is in removable electrical contact with the first electrically conductive support standard of the first upright subassembly and a second end of the LED array disposed within the at least one shelf fixture is in removable electrical contact with the second electrically conductive support standard of the second upright subassembly; and a power supply of less than or equal to 48 volts in electrical contact with the first electrically conductive support standard of the first upright subassembly and the second electrically conductive support standard of the second upright subassembly, configured to provide the electrical current to the LED array when the least one fixture is mounted to the first electrically conductive support standard of the first upright subassembly the second electrically conductive support standard of the second upright subassembly.

* * * * *